US007796099B2

(12) United States Patent
Osame et al.

(10) Patent No.: US 7,796,099 B2
(45) Date of Patent: Sep. 14, 2010

(54) LIGHT EMITTING DEVICE AND DRIVING METHOD THEREOF

(75) Inventors: Mitsuaki Osame, Kanagawa-Ken (JP); Yu Yamazaki, Kanagawa-Ken (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 321 days.

(21) Appl. No.: 11/379,145

(22) Filed: Apr. 18, 2006

(65) Prior Publication Data

US 2006/0186832 A1 Aug. 24, 2006

Related U.S. Application Data

(62) Division of application No. 10/654,511, filed on Sep. 4, 2003, now Pat. No. 7,112,927.

(30) Foreign Application Priority Data

Sep. 5, 2002 (JP) ..... 2002-259912

(51) Int. Cl.
*G09G 3/101* (2006.01)

(52) U.S. Cl. ..... 345/76; 345/77; 345/204

(58) Field of Classification Search ..... 345/76, 345/77, 78, 83, 82, 84, 92, 204; 315/169.3
See application file for complete search history.

(56) References Cited

U.S. PATENT DOCUMENTS 5,598,021 A 1/1997 O
5,641,991 A 6/1997 Sakoh
5,652,600 A 7/1997 Khormaei
5,807,627 A 9/1998 Friend
5,812,105 A 9/1998 Van de Ven
5,882,761 A 3/1999 Kawami (Continued)

FOREIGN PATENT DOCUMENTS

CN 1 355 664 6/2002

(Continued)

OTHER PUBLICATIONS

International Search Report (Application No. PCT/JP03/11304) dated Oct. 28, 2003; 6 pages.

(Continued)

*Primary Examiner*—David Hung Vu
(74) *Attorney, Agent, or Firm*—Fish & Richardson P.C.

(57) ABSTRACT

A light emitting device which is able to suppress power consumption while a balance of white light is maintained is provided. According to the present invention, either the potential level of the Hi video signal or Lo video signal which is given to a gate electrode of a transistor, and the potential level of the power source lines are changed by the respective corresponding colors. Concretely, the potential level at the side of Lo and the potential level of the power source line are made to be changed by the respective corresponding colors when a transistor which controls current supplied to a light emitting element is a p-channel type. Conversely, the potential level at the side of the Hi and potential level of the power source line are made to be changed by the respective corresponding colors when a transistor which controls current supplied to a light emitting element is an n-channel type.

18 Claims, 13 Drawing Sheets

U.S. PATENT DOCUMENTS

| | | | | |
|---|---|---|---|---|
| 5,990,629 | A | 11/1999 | Yamada | |
| 6,057,647 | A | 5/2000 | Kurosawa | |
| 6,147,667 | A | 11/2000 | Yamazaki | |
| 6,165,824 | A | 12/2000 | Takano | |
| 6,175,345 | B1 | 1/2001 | Kuribayashi | |
| 6,191,764 | B1 | 2/2001 | Kono | |
| 6,246,070 | B1 | 6/2001 | Yamazaki | |
| 6,255,705 | B1 | 7/2001 | Zhang | |
| 6,259,138 | B1 | 7/2001 | Ohtani | |
| 6,259,838 | B1 | 7/2001 | Singh | |
| 6,313,481 | B1 | 11/2001 | Ohtani | |
| 6,351,077 | B1 | 2/2002 | Koyama | |
| 6,373,455 | B1 | 4/2002 | Kuribayashi | |
| 6,380,688 | B1 | 4/2002 | Bae | |
| 6,392,617 | B1 | 5/2002 | Gleason | |
| 6,479,333 | B1 | 11/2002 | Takano | |
| 6,501,227 | B1 | 12/2002 | Koyama | |
| 6,576,926 | B1 | 6/2003 | Yamazaki | |
| 6,700,330 | B2 | 3/2004 | Koyama | |
| 6,825,820 | B2 | 11/2004 | Yamazaki et al. | |
| 6,879,110 | B2 | 4/2005 | Koyama | |
| 7,176,857 | B2 * | 2/2007 | Osame et al. | 345/76 |
| 7,639,248 | B2 | 12/2009 | Yamazaki et al. | |
| 2001/0035863 | A1 | 11/2001 | Kimura | |
| 2002/0018060 | A1 | 2/2002 | Yamazaki | |
| 2002/0021293 | A1 | 2/2002 | Tam | |
| 2002/0033718 | A1 | 3/2002 | Tam | |
| 2002/0047581 | A1 | 4/2002 | Koyama | |
| 2002/0063536 | A1 | 5/2002 | Koyama | |
| 2003/0117083 | A1 | 6/2003 | Koyama | |
| 2003/0197179 | A1 | 10/2003 | Yamazaki | |
| 2003/0197664 | A1 * | 10/2003 | Koyama | 345/76 |
| 2004/0021426 | A1 | 2/2004 | Osame | |
| 2004/0239599 | A1 | 12/2004 | Koyama | |
| 2007/0085783 | A1 | 4/2007 | Koyama | |

FOREIGN PATENT DOCUMENTS

| | | | |
|---|---|---|---|
| EP | 0 883 191 | | 12/1988 |
| EP | 0 776 147 | | 5/1997 |
| EP | 0 883 191 | | 12/1998 |
| EP | 1 031 873 | | 8/2000 |
| EP | 1 033 765 | | 9/2000 |
| EP | 1 087 366 | | 3/2001 |
| EP | 1 096 466 | | 5/2001 |
| EP | 1 170 718 | | 1/2002 |
| EP | 1 170 719 | | 1/2002 |
| EP | 1 202 242 | | 5/2002 |
| EP | 1 713 054 | A2 | 10/2006 |
| GB | 2 360 870 | | 10/2001 |
| GB | 2 364 592 | | 1/2002 |
| GB | 2 364 593 | | 1/2002 |
| JP | 08-078519 | | 3/1996 |
| JP | 09-148066 | | 6/1997 |
| JP | 10-039791 | | 2/1998 |
| JP | 10-214060 | | 8/1998 |
| JP | 10-232649 | | 9/1998 |
| JP | 10-247735 | | 9/1998 |
| JP | 10-312173 | | 11/1998 |
| JP | 3032801 | | 4/2000 |
| JP | 2001-159878 | | 6/2001 |
| JP | 2002-108285 | A | 4/2002 |
| JP | 2002-151276 | A | 5/2002 |
| KR | 2001-0050612 | A | 6/2001 |
| WO | WO 98-33165 | | 7/1998 |
| WO | WO 01/75853 | | 10/2001 |
| WO | WO 02/05254 | | 1/2002 |
| WO | WO 02/05255 | | 1/2002 |

OTHER PUBLICATIONS

China 1 355 644—English Abstract: esp@cenet.com and family to U.S. Patent Application Publication No. 2004-0219599(Desig. ID "AA") and European Patent No. 1 202 242 (Desig. ID "AM").

Peoples Republic of China—First Office Action (Application No. 03821098.3), dated Apr. 27, 2007, including full English translation, 29 pages.

* cited by examiner

LIGHT EMITTING DEVICE AND DRIVING METHOD THEREOF

This application is a Continuation-In-Part of U.S. Utility Patent Application Ser. No. 10/654,511 filed on Sep. 4, 2003, now U.S. Pat. No. 7,112,927.

BACKGROUND OF THE INVENTION

1. Field of the Invention

The present invention relates to a light emitting device in which a unit for supplying current to a light emitting element and a light emitting element are provided in each of plural pixels, and more particularly a device substrate corresponding to a form of a light emitting element which is not yet completely fabricated in the process of manufacturing the light emitting device in which a unit for supplying current to a light emitting element is provided in each of a pluralities of pixels.

2. Description of the Related Art

Next, a pixel structure of a general light emitting device and the drive thereof will be described briefly. A pixel shown in FIG. 10A has TFTs 80 and 81, a storage capacitor 82 and a light emitting element 83. Note that, a storage capacitor 82 need not always be formed.

In the TFT 80, a gate electrode is connected to a scanning line 85, one of a source region and a drain region of the TFT 80 is connected to a signal line 84 and the other is connected to the gate electrode of the TFT 81. In the TFT 81, a source region is connected to a power source line 86, and a drain region is connected to an anode of the light emitting element 83. The storage capacitor 82 is provided so as to retain voltage between the gate electrode and the source region of the TFT 81. The power source line 86 and the cathode of the light emitting element 83 are respectively applied with predetermined potential from the power source and have mutual potential difference.

Note that, a connection means an electrical connection in this specification, if there is no specific description.

When the TFT 80 is turned on by potential of the scanning line 85, potential of a video signal input to the signal line 84 is given to the gate electrode of the TFT 81. In accordance with the potential of the input video signal, a gate voltage (a voltage difference between the gate electrode and the source region) of the TFT 81 is determined. Then, drain current that flows in accordance with the gate voltage is supplied to the light emitting element 83 and the light emitting element emits light in accordance with the supplied current.

A pixel structure in general light emitting device, which is different from FIG. 10A is shown in FIG. 10B. The pixel shown in FIG. 10B has TFTs 60, 61 and 67, a storage capacitor 62, and a light emitting element 63. It is noted that the storage capacitor 62 is not necessarily provided.

In the TFT 60, a gate electrode connected to a first scanning line 65, one of a source region and a drain region is connected to a signal line 64, and the other is connected to a gate electrode of the TFT 61. In the TFT 67, a gate electrode is connected to a second scanning line 68, one of a source region and a drain region is connected to a power source line 66, and the other is connected to a gate electrode of the TFT 61. In the TFT 61, a source region is connected to the power source line 66 and a drain region is connected to an anode of the light emitting element 63. The storage capacitor 62 is provided in order to keep voltage between the gate electrode and the source region of the TFT 61. The power source line 66 and the cathode of the light emitting element 63 are respectively applied with predetermined potential from the power source and have mutual potential difference.

When the TFT 60 is turned on in accordance with potential of the first scanning line 65, potential of a video signal input to the source line 64 is given to the gate electrode of the TFT 61. In accordance with the potential of the input video signal, a gate voltage (a voltage difference between the gate electrode and the source region) of the TFT 61 is determined. Then, drain current of the TFT 61 that flows in accordance with the gate voltage is supplied to the light emitting element 63 and the light emitting element 63 emits light in accordance with the supplied current.

In addition, in the pixel shown in FIG. 10B, when the TFT 67 is turned on in accordance with potential of the second scanning line 68, potential of the power source line 66 is given to the both the gate electrode and the source region of the TFT 61, and therefore the TFT 61 is turned off and the light emitting element 63 is forced to finish emitting a light.

Now, in many electroluminescence materials in which electroluminescence can be obtained by impressing electric field, luminance of red luminescence is generally low, compared with luminance of blue or green luminescence. In the case of applying a light emitting element using an electroluminescence material with such a characteristic to a light emitting device, luminance of red in a displayed image is likely to be naturally low.

Especially, in the case of a color display method of forming three kinds of light emitting elements corresponding to R (red), G (green), and B (blue) respectively, it is difficult to control a balance of white color.

It has been conventionally carried out the way to use orange light with a little wavelength than red light as red light. However, with this way, an image to be displayed as red image is displayed as orange as a result and then, the purity of red light is low and.

Then, as a means for controlling the balance of luminance of red, blue, and green luminescence, it is generally employed to make current supplied to a pixel different from each other in displaying RGB (red, green, and blue). Specifically, it is possible to make the current supplied to a pixel different and keep the balance of white light when potential difference between a power source line and cathode of a light emitting element is made different for each of RGB. (ref. Japanese Patent Laid Open No. 2001-159878. $5^{th}$ page)

SUMMARY OF THE INVENTION

There was, however, a problem to be solved in the above method. In making potential of the power source line different for each pixel of RGB, it is necessary, in order to completely turned on a TFT for controlling current supplied to the light emitting element, to determine potential of a video signal in accordance with either the power source line with the lowest potential when the TFT is p-channel type TFT or the power source line with the highest potential when the TFT is an n-channel type TFT.

For example, in the case of a pixel shown in FIG. 10A, lower potential (hereinafter referred to as Lo) of the video signal is made to be lower than potential of the power source line 86 so that the TFT 81 is turned on since the TFT 81 is a p-channel type TFT. Therefore, the potential of Lo of the video signal is set to be lower than the lowest potential of the power source line when the source potential is changed for each of RGB. However, although it is not necessary that the potential of the Lo of the video signal in a pixel corresponding to B or G is set as low as that in a pixel corresponding to R, in the case that potential of the power source line corresponding to R is set to the lowest, waste power consumption is increased.

In addition, similar in the case of a pixel shown in FIG. 10B, waste power consumption is increased when the potential of the video signal is determined in accordance with the power source line with the lowest potential in order to turn on the TFT 61. Further, similarly to the case of the p-channel type TFT, waste power consumption is naturally increased in the case of the n-channel type TFT when lower potential (hereinafter referred to as Hi) of the video signal is determined in accordance with the power source line with the highest potential.

In view of the above problem, it is an object of the present invention to provide a light emitting device which is able to suppress the power consumption of a panel while a balance of white light is maintained.

According to the present invention, the potential level of the video signal, either one of Hi or Lo of the video signal which is given to a gate electrode of a transistor controlling the current supplied to a light emitting element, and the potential level of the power source line are changed depending on the respective corresponding colors.

Concretely, the potential level at the side of Lo and the potential level of the power source line are made to be changed depending on the respective corresponding colors when a transistor which controls the current supplied to a light emitting element is p-channel type. Conversely, the potential level at the side of the Hi and potential level of the power source line are made to be changed depending on the respective corresponding colors when a transistor which controls the current supplied to a light emitting element is n-channel type.

According to the present invention, by the above-described structure, the balance of white color is maintained without increasing or reducing the potential of the power source line more than necessary and the power consumption of the panel can be restrained.

DESCRIPTION OF THE PREFERRED EMBODIMENTS

Embodiment Mode

In the present embodiment mode, a structure of a light emitting device in which potential of Lo of the video signal which is input to the pixel and the power source potential can be changed depending on the respective corresponding colors of RGB will be described. Note that a light emitting device in the present invention includes a panel in which a light emitting element is sealed, and a module in which such as an IC including a controller, is mounted to the panel.

Figure 1:
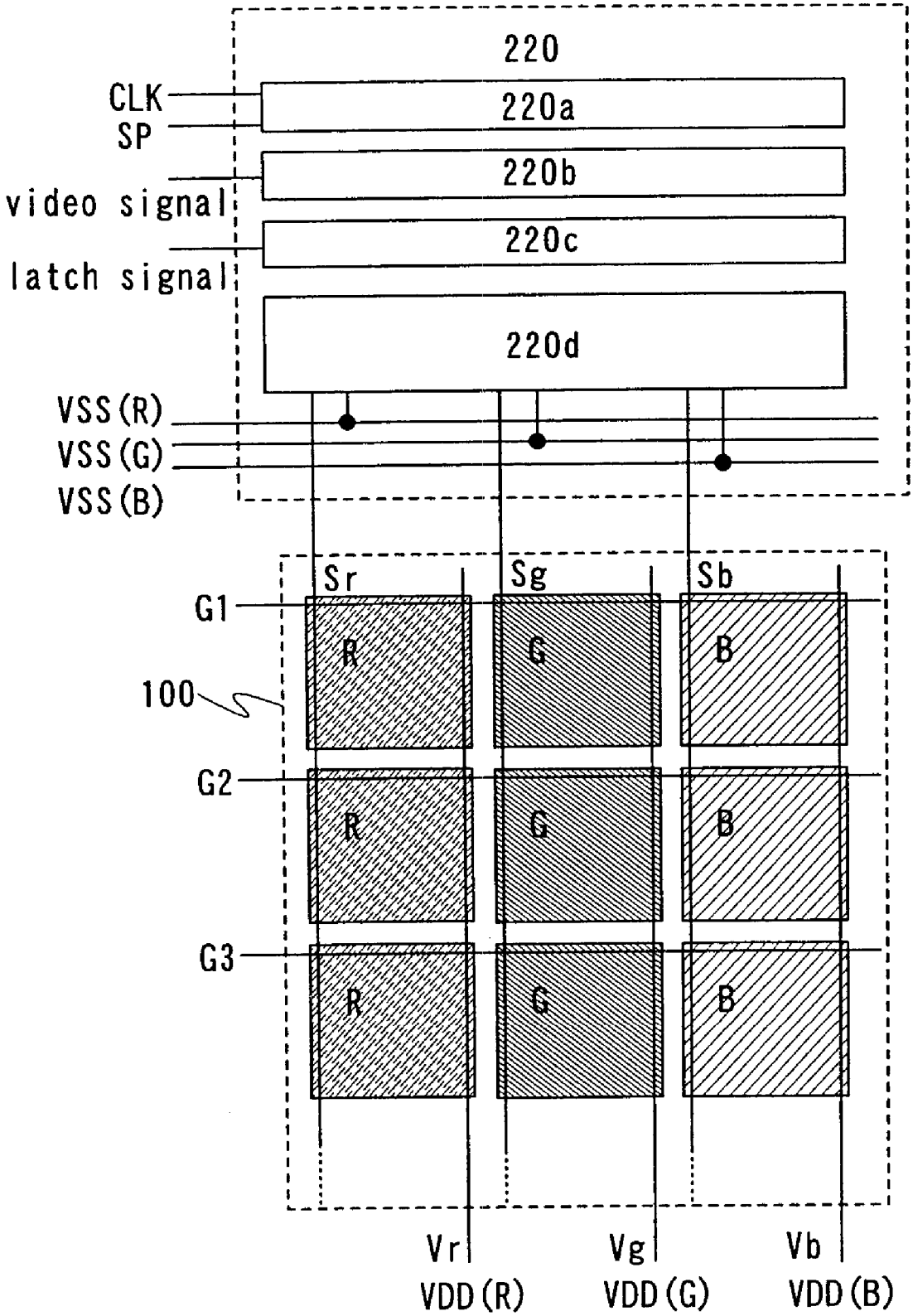
FIG. 1 is a block diagram showing a structure of a light emitting device according to the present invention.

FIG. 1 is a block diagram that shows a pixel potion 100 and a signal line drive circuit 220 in a light emitting device according to the present invention.

In the pixel portion 100, pixels each corresponding to R, G, or B, and potential is given to each pixel from each of a signal line, a power source line, and a scanning line. Potential (specifically, potential of a video signal) given to one signal line is given to a plurality of pixels corresponding to the same color, and potential given to one power source line is given to a plurality of pixels corresponding to the same color.

In FIG. 1, signal lines corresponding to RGB are denoted by Sr, Sg, and Sb, respectively, and power source lines corresponding to RGB are denoted by Vr, Vg, and Vb, respectively. It is noted that the light emitting device of the present invention is not limited on the number of signal lines or power source lines, there may be a plurality of source lines or power source lines corresponding to each color. Although FIG. 1 shows the case in which scanning lines are three, the number of scanning lines is not limited hereto.

Figure 10A:
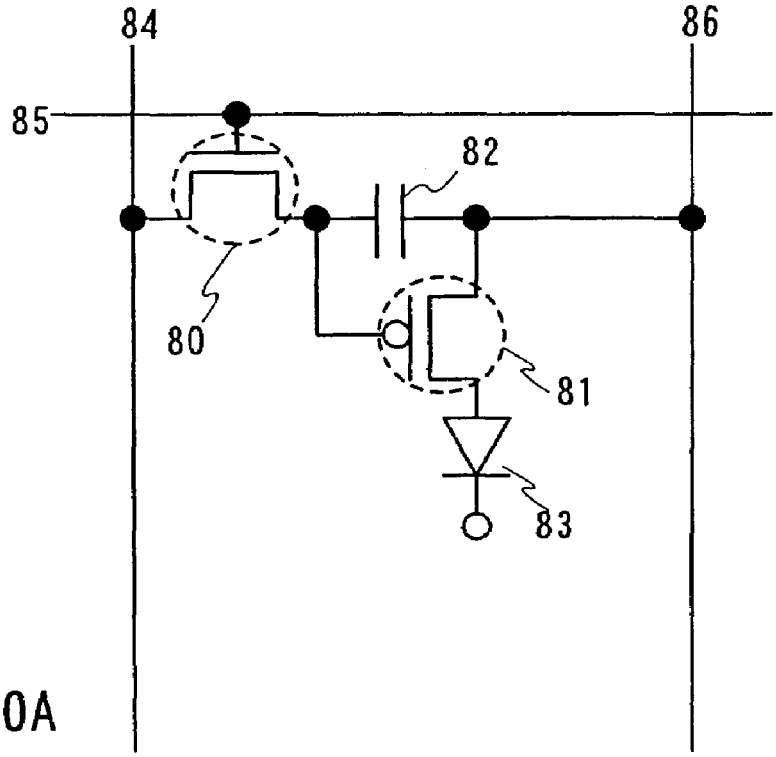
FIGS. 10A and 10B are general circuit diagrams for pixels.
Figure 10B:
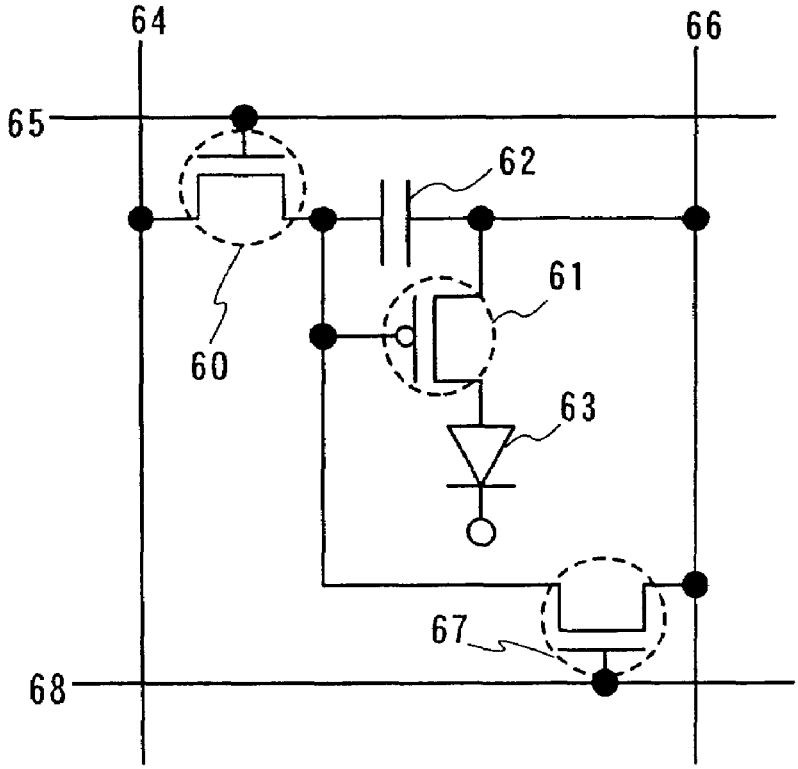

Although it is assumed in the present embodiment mode that two transistors are provided in a pixel as shown in FIG. 10A, the present invention is not limited to this structure. For example, it may be assumed that three transistors are provided in a pixel as shown in FIG. 10B. Only what is necessary is that a light emitting device of the present invention is an active matrix light emitting device that is capable of time division gray scale display with digital video signals.

Note that switching TFT can be either of n-type or p-type.

The signal line drive circuit 220 shown in FIG. 1 has a shift register 220*a*, a memory circuit A 220*b*, a memory circuit B 220*c*, and a level shifter 220*d*.

In this embodiment mode, the case in which a transistor (a driving transistor) that controls current running through a light emitting element is a p-channel type transistor is described. In the case that the driving transistor is the p-channel type transistor, a power source potential VDD (R) is given to the power source line Vr, power source potential VDD (G) is given to the power source line Vg, and power source potential VDD (B) is given to the power source line Vb from a power source circuit installed in the exterior of a panel. Power source potential VSS (R) to be used as potential of Lo of a video signal corresponding to R, power source potential VSS (G) to be used as potential of Lo of a video signal corresponding to G, and power source potential VSS (B) to be used as potential of Lo of a video signal corresponding to B are given to a level shifter 220*d* from a power source circuit installed in the exterior of a panel.

It is noted that VSS (R)<VDD (R), VSS (G)<VDD (G), and VSS (B)<VDD (B).

The level of the power source potential VDD (R), the power source potential (G), and the power source potential (B) are different from each other in this embodiment mode. However, it is not strictly necessary that all levels of the power source potential VDD are different from each other as long as one level of power source potential corresponding to any one of colors is different from the level of power source potential corresponding to the other colors.

Figure 2A:
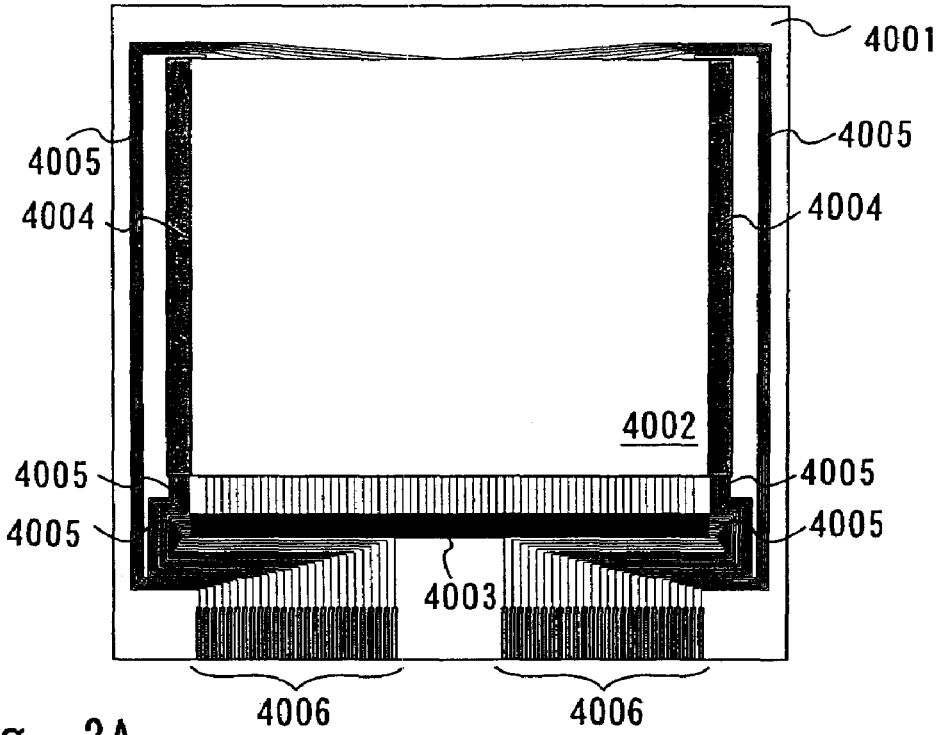
FIG. 2A is a top view of a device substrate of the light emitting device and 2B is an enlarged view of a connection terminal according to the present invention.

In the light emitting device of the present invention, the power source potential VSS and the power source potential VDD are given via a connection terminal provided in the panel. FIG. 2A is a top view showing a device substrate that is one mode of the light emitting device according to the present invention.

The device substrate shown in FIG. 2A is comprising a pixel portion 4002 in which a light emitting device is provided in each pixel therein; a scanning line drive circuit 4004 for selecting a pixel in the pixel portion 4002; and a signal line drive circuit 4003 for supplying a video signal to the selected pixel over a substrate 4001. The number of the signal line drive circuit and the scanning line drive circuit is not limited to the number illustrated in FIG. 2A. It is possible that the number of the signal line drive circuit and the scanning line drive circuit can be appropriately set by the designer.

Reference numeral 4005 is a drawing circuit for giving power source potential inputted via a connection terminal 4006 or various signals to the pixel portion 4002, the scanning line drive circuit 4004, and the signal line drive circuit 4003.

Figure 2B:
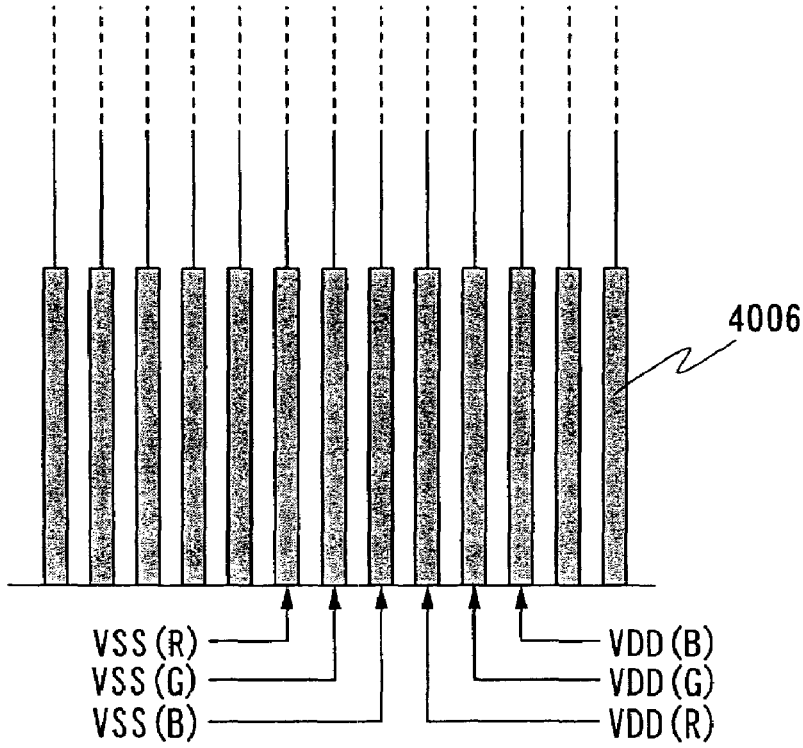

FIG. 2B is an enlarged view of a connection terminal 4006. In the light emitting device according to the present invention, in the case that the levels of the power source potential for given to a power source line are different from one color to another, the power source potential is inputted via the different connection terminal 4006 for each power source potential to the inside of the panel. In this embodiment mode, the levels of power source potential are different among R, G, B, so that each power source potential is inputted via the different connection terminal 4006 for each power source potential.

Figure 3A:
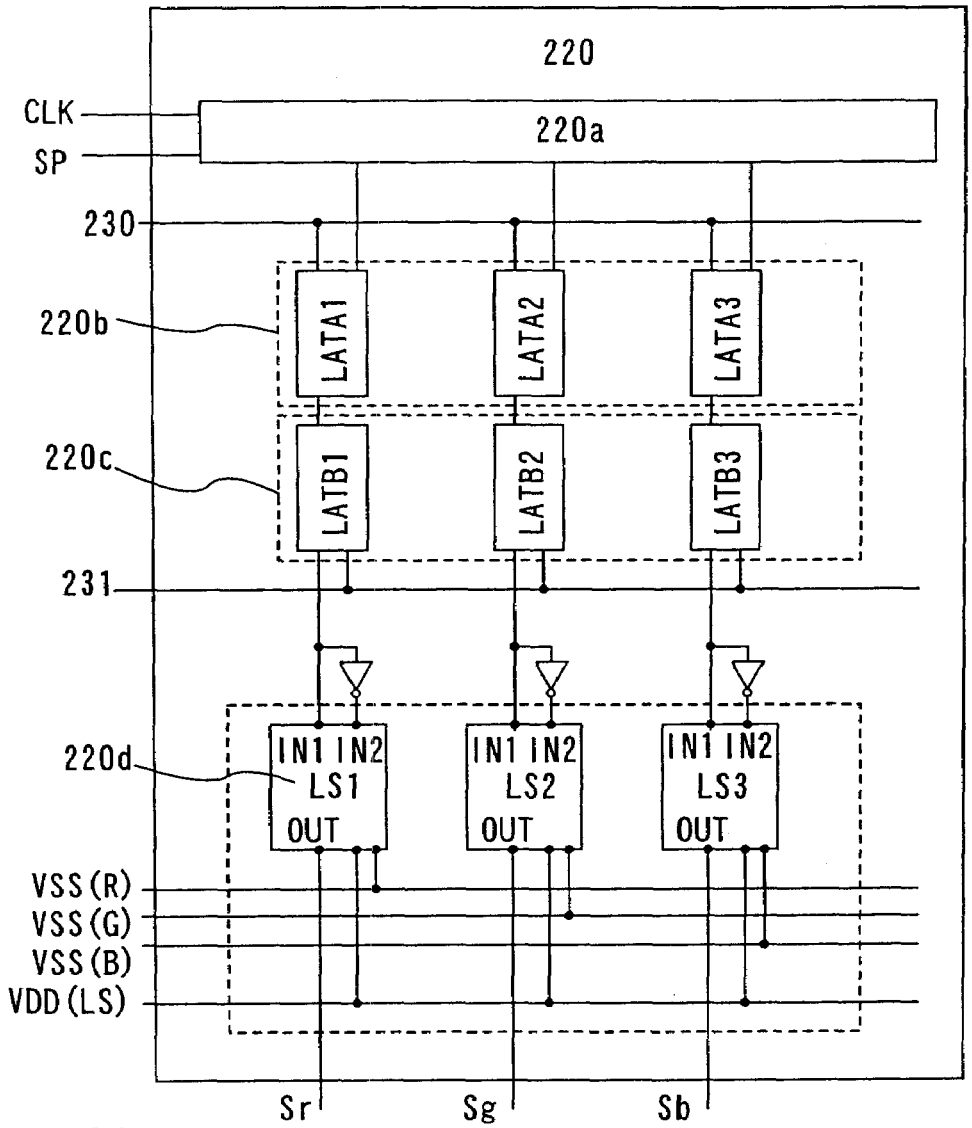
FIG. 3A is a block diagram of a signal line drive circuit and 3B is a circuit diagram of a level shifter.

A block diagram of FIG. 3A shows more detailed structure of a signal line drive circuit 220. Hereafter, the drive of the signal line drive circuit 220 will be simply explained.

First, when a clock signal CLK and a start pulse signal SP are input to a shift register 220*a*, a timing signal is generated to be input to each of a plurality of latches A (LATA1 to LATA3) held in a memory circuit A 220*b*. At this time, the timing signal generated in the shift register 220*a* may be input to each of the plurality of latches A (LATA1 to LATA3) held in the memory circuit A 220*b* after amplifying the timing signal via a buffering means such as a buffer.

When the timing signal is input to the memory circuit A 220*b*, one bit of video signal input to a video signal line 230 is written into each of the plurality of latches A (LATA1 to LATA3) sequentially and stored therein in accordance with the timing signal. A period of time during once completion of writing video signals into all stages of latches in the memory circuit A 220*b* is referred to as a line period. Actually, there is a case that the line period includes the period in which a horizontal retrace period is added to the line period.

After terminating one line period, latch signals are delivered to a plurality of latches B (LATB1 to LATB3) held in the memory circuit B 220*c* via a latch signal line 231. Simultaneously, the video signals stored in the plurality of latches A (LATA1 to LATA3) held in the memory circuit A 220*b* are written all at once into the plurality of latches B (LATB1 to LATB3) held in the memory circuit B 220*c* and stored therein.

After fully delivering the retained video signals to the memory circuit B 220*c*, video signals corresponding to the following one bit are sequentially written into the memory circuit A 220*b* again synchronously in accordance with the timing signal fed from the shift register 220*a*. During the second-round one-line period, the video signals stored in the memory circuit B 220*c* are delivered to the level shifter 220*d*.

The level shifter 220*d* amplifies amplitude of the video signals inputted, and then provides the amplified video signals to respective signal lines. The power source potential VSS corresponding to each color is used for amplifying the amplitude of the video signals.

Figure 3B:
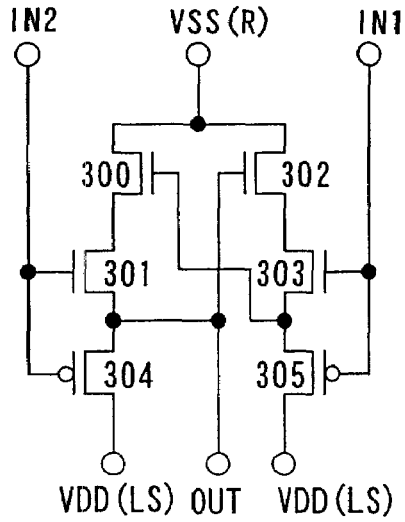

One example of a level shifter is shown in a circuit diagram of FIG. 3B. The level shifter shown in FIG. 3B has four n-channel type transistors 300 to 303 and two p-channel type transistors 304 and 305.

The power source potential VSS is given to source regions of the n-channel type transistor 300 and 302. In the present embodiment mode, the power source potential VSS (R), the power source potential VSS (G), and the power source potential VSS (B) are given to the level shifter corresponding to R, the level shifter corresponding to G, the level shifter corresponding to B, respectively. In FIG. 3B, an example in which the power source potential VSS (R) is given to the level shifter corresponding to R is illustrated.

Further, a drain region of the n-channel type transistor 300 is connected to a source region of the n-channel type transistor 301, a drain region of the n-channel type transistor 301 is connected to a drain region of the p-channel type transistor 304, a drain region of the p-channel type transistor 302 is connected to a source region of the n-channel type transistor 303, and a drain region of the n-channel type transistor 303 is connected to a drain region of the p-channel type transistor 305.

In addition, the power source potential VDD (LS) for the level shifter is given to source regions of the p-channel type transistors 304 and 305. The power source potential VDD (LS) is common to the level shifter corresponding all the colors. Note that the potential of the VDD (LS) is set to be equal to or more than that of the highest potential of power source line. It is noted that the VSS corresponding each color is smaller than the VDD (VSS<VDD (LS)).

A gate electrode of the n-channel type transistor 300 is connected to the drain region of the n-channel type transistor 303, and gate electrodes of the n-channel type transistor 301 and the p-channel type transistor 304 are applied with potential $IN_2$ of the video signal the polarity of which is inverted by the memory circuit B220*c*.

Potential $IN_1$ of a video signal is given to gate electrodes of the n-channel type transistor 303 and p-channel type transistor 305 from the memory circuit B220*c*. A gate electrode of the n-channel type TFT 302 is connected to a drain region of the lo n-channel type TFT 301, and potential of the node is given to each signal line as potential of the amplified video signal OUT.

Then, the potential of Hi of the amplified video signal output from the level shifter is kept at the same level as the VDD(LS) and potential of Lo of the video signal is kept at the same level as the VSS corresponding to each color. Then, the amplified video signal is supplied to a pixel corresponding to each color via the signal line.

The potential of the video signal is given to the gate electrode of the transistor which controls current supplied to a light emitting element Meanwhile, power source potential VDD(R), VDD(G) and VDD(B) are applied to power source lines Vr, Vg and Vb in correspondence with respective colors.

Figure 4A:
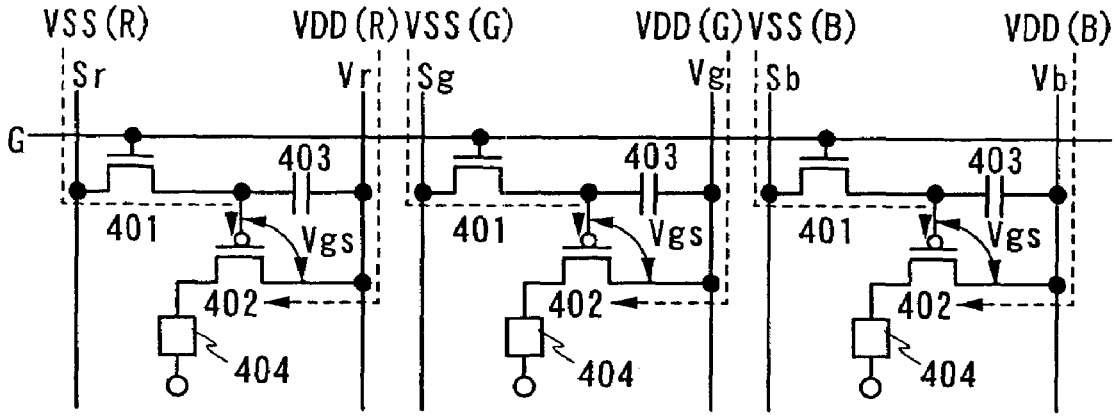
FIGS. 4A and 4B are circuit diagrams of a pixel portion of a light emitting device according to the present invention.

An explanation will be given of operation of the pixel when VSS(R), VSS(G) and VSS(B) are respectively applied to signal lines Sr, Sg and Sb in reference to FIG. 4A. When a scanning line G is selected, all of switching transistors 401 of the respective pixels are turned ON and potential VSS(R), VSS(G) and VSS(B) of the video signal applied to the respective signal lines Sr, Sg and Sb are applied to gate electrodes of driving transistors 402 of the respective pixels.

Meanwhile, the power source lines Vr, Vg and Vb are respectively applied with the power source potential VDD (R), VDD(G) and VDD(B) and the respective power source potential VDD(R), VDD(G) and VDD(B) are respectively applied to source regions of the driving transistors 402 of the corresponding pixels.

Therefore, gate voltage Vgs of the driving transistors 402 of the respective pixels becomes VSS(R)−VDD(R) in the case of the pixel for R, VSS(G)−VDD(G) in the case of the pixel for G, and VSS(B)−VDD(B) in the case of the pixel for B. Here, since VSS(R)<VDD(R), VSS(G)<VDD(G) and VSS(B)<VDD(B), the gate voltage Vgs becomes negative and when a threshold is assumed to be −2V, the driving transistors 402 are turned ON. Therefore, light emitting elements 404 are brought into a luminous state. Further, the gate voltage of the respective pixels is held at storage capacitors 403.

According to the embodiment, it is assumed to correct to increase brightness of the light emitting element 404 of R and to reduce brightness of the light emitting element 404 of G and to take balance of white color. In this case, it is assumed that VSS(R)−VDD(R)>VSS(B)−VDD(B)>VSS(G)−VDD (G). Also, it is assumed that VDD(R)>VDD(B)>VDD(G). Therefore, since the highest potential of the power source line is VDD(R), VDD(LS)≧VDD(R)>VDD(B)>VDD(G).

Further, the light emitting element 404 includes an anode and a cathode and according to the specification, when the anode is used as a pixel electrode, the cathode is referred to as an opposed electrode and when the cathode is used as the pixel electrode, the anode is referred to as the opposed electrode. Further, when the anode is used as the pixel electrode and the cathode is used as the opposed electrode, it is preferable that the driving transistor 402 is a p-channel type transistor. Conversely, when the anode is used as the opposed electrode and the cathode is used as the pixel electrode, it is preferable that the driving transistor 402 is an n-channel type transistor. In either of the cases, the opposed electrode of the light emitting element 404 is applied with common power source potential. Further, levels of the power source potential of the opposed electrode and the respective power source potential VDD(R), VDD(G) and VDD(B) of the power source lines are determined such that voltage of inverted direction bias is applied to the light emitting elements 404 when the driving transistor 402 is made on.

Further, although the correction is carried out such that the brightness of R is increased and the brightness of G is reduced according to the embodiment, the invention is not limited thereto. The levels of the respective potential are made to be changed pertinently in accordance with properties of electroluminescence materials used in the light emitting elements.

Further, it is not necessarily needed that VDD in correspondence with a color which is intended to increase of brightness is higher than VDD in correspondence with other colors. A voltage applied to a light emitting element of a color which is intended to increase the brightness may be larger than a voltage applied to a light emitting element in correspondence with other colors. Therefore, a relationship between the power source potential VSS in correspondence with each color and the level of the power source potential VDD is not limited to a relationship shown in the embodiment.

Further, it is not necessarily needed that potential difference between VSS and VDD of a color which is intended to increase the brightness is higher than potential difference between VSS and VDD of other colors in a case that a luminous efficiency of electroluminescence material of a color which is intended to increase the brightness is remarkably higher than that of electroluminescence material of other colors.

Figure 4B:
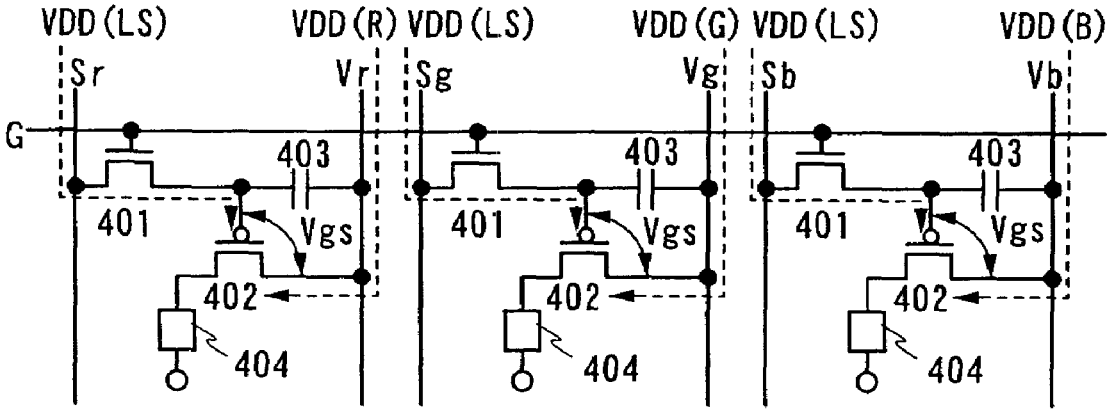

Next, an explanation will be given of operation of the pixel when VDD(LS) is respectively applied to the signal lines Sr, Sg and Sb in reference to FIG. 4B. When the scanning line G is selected, all of the switching transistors 401 of the respective pixels are turned ON and potential VDD(LS) of a video signal applied to the respective signal lines Sr, Sg and Sb is applied to the gate electrodes of the driving transistors 402 of the respective pixels.

Meanwhile, the power source lines Vr, Vg and Vb are respectively applied with the power source potential VDD (R), VDD(G) and VDD(B) and the respective power source potential VDD(R), VDD(G) and VDD(B) are respectively applied to the source regions of the driving transistors 402 of the corresponding pixels.

Therefore, the gate voltage Vgs of the driving transistors 402 of the respective pixels becomes VDD(LS)−VDD(R) in the case of the pixel for R, VDD(LS)−VDD(G) in the case of the pixel for G and VDD(LS)−VDD(B) in the case of the pixel for B. Here, since VDD(LS)≧VDD(R)>VDD(B)>VDD(G), all of the gate voltages Vgs become equal to or higher than 0, when the threshold is assumed to be −2V, the driving transistors 402 are turned OFF. Therefore, the light emitting elements are brought into a switched off state.

Further, an explanation has been given of the above-described operation by assuming a case in which the driving transistor for controlling current supplied to the light emitting element is of a p-channel type. Next, an explanation will be given of a case in which the driving transistor is of an n-channel type.

When the driving transistor is of an n-channel type, as potential of a power source line, power source potential VSS in correspondence with each color is used. Specifically, power source potential VSS(R) is applied to the power source line Vr, power source potential VSS(G) is applied to the power source line Vg and power source potential VSS(B) is applied to the power source line Vb from a power source circuit provided at outside of a panel.

Further, any one of levels of the power source potential VSS(R), the power source potential VSS(G) and the power source potential VSS(B) applied to the power source lines may differ and it is not necessarily needed that levels of all of the power source potential VSS differ from each other.

Further, when the driving transistor is of the n-channel type, as potential of Hi of the video signals inputted to the pixels, the power source potential VDD in correspondence with the respective colors are used. The potential of Hi of the video signal can be changed for respective corresponding colors by changing, for example, a level of the power source potential VI)D applied to a level shifter. Specifically, power source potential VDD(R) used as potential of Hi of a video signal in correspondence with R, power source potential VDD(G) used as the potential of Hi of a video signal in correspondence with G and power source potential of VDD (B) used as potential of Hi of a video signal in correspondence with B are applied from the power source circuit provided at outside of the panel to the level shifters 220*d* in correspondence with respective colors.

Incidentally, it is assumed that VDD(R)>VSS(R), VDD(G) >VSS(G) and VDD(B)>VSS(B).

The level shifters 220*d* amplify amplitudes of the video signals by using the applied power source potential VDD(R), VDD(G) and VDD(B) to supply to the respective signal lines.

Figure 11:
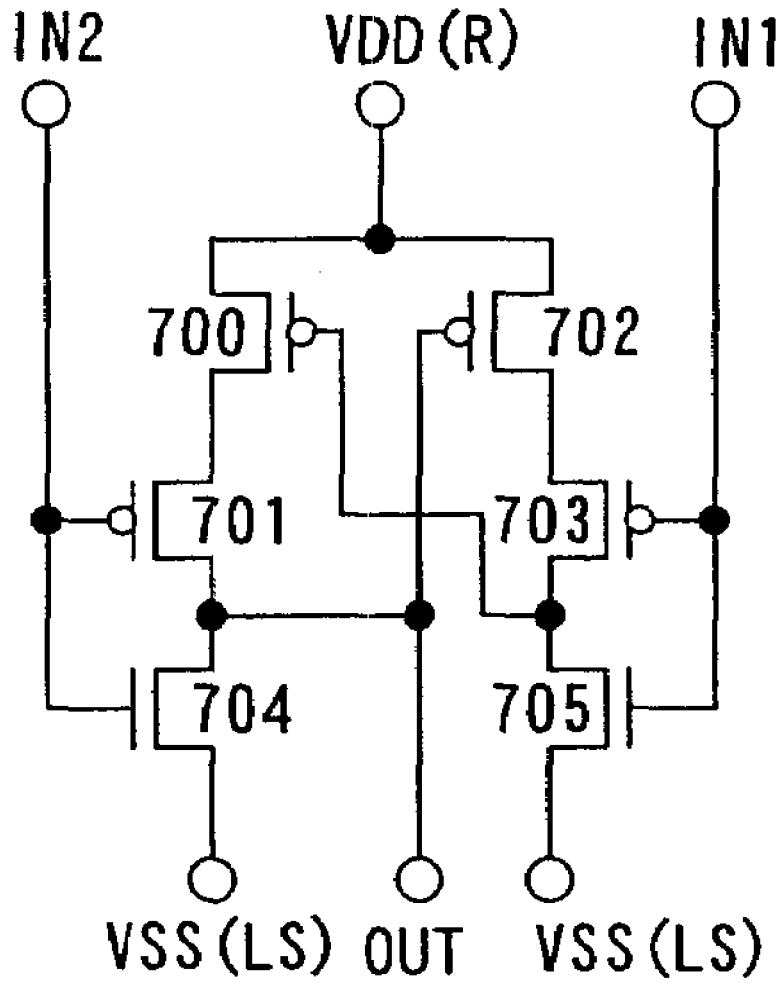
FIG. 11 is a circuit diagram of a level shifter.

FIG. 11 shows a structure of a level shifter used when the driving transistor is of the n-channel type. The level shifter shown FIG. 11 is provided with four of p-channel type transistors 700 through 703 and two of n-channel type transistors 704 and 705.

A source region of the p-channel type transistor 700 and a source region of the p-channel type transistor 702 are applied with any one of the power source region potential VDD(R), VDD(G) and VDD(B)in correspondence with the respective colors. FIG. 11 shows an example of applying VDD(R) to a level shifter in correspondence with R.

Further, a drain region of the p-channel type transistor 700 is connected with a source region of the p-channel type transistor 701 and a drain region of the p-channel type transistor 701 is connected with a drain region of the n-channel type transistor 704. Further, a drain region of the p-channel type transistor 702 is connected with a source region of the p-channel type transistor 703 and a drain region of the p-channel type transistor 703 is connected with a drain region of the n-channel type transistor 705.

A gate electrode of the p-channel type transistor 700 is connected to the drain region of the p-channel type transistor 703 and gate electrodes of the p-channel type transistor 701 and the n-channel type transistor 704 are applied with potential $IN_2$ of the video signal the polarity of which is inverted by the storing circuit B220*c*.

Gates of the p-channel type transistor 703 and the n-channel type transistor 705 are applied with potential $IN_1$ of the video signal from the storing circuit B220*c*. A gate electrode of the p-channel type transistor 702 is connected to the drain region of the p-channel type transistor 701 and potential of the node is applied to the respective signal lines as potential of the video signal OUT after having been amplified.

Further, a source region of the n-channel type transistor 704 and a source region of the n-channel type transistor 705 are applied with the power source potential VSS(LS) for the level shifter. Power source potential VSS(LS) is common in the level shifters in correspondence with all of the colors. Further, VDD>VSS(LS) for all of VDD in correspondence with the respective colors and VSS(LS) is set to be equal to or lower than potential of a power source line having the lowest potential.

According to the video signal after having been amplified outputted from the level shifter, potential of Lo is maintained at a level the same as that of VSS(LS) and potential of Hi is maintained at a level the same as that of the power source potential VDD in correspondence with each color. Further, a video signal is supplied to the pixel in correspondence with each color via the signal line.

In the pixel, the potential of the video signal is applied to a gate electrode of a transistor for controlling current applied to the light emitting element.

Meanwhile, the power source potential VSS(R), VSS(G) and VSS(B) are applied to the power source lines Vr, Vg and Vb in correspondence with the respective colors.

Figure 13A:
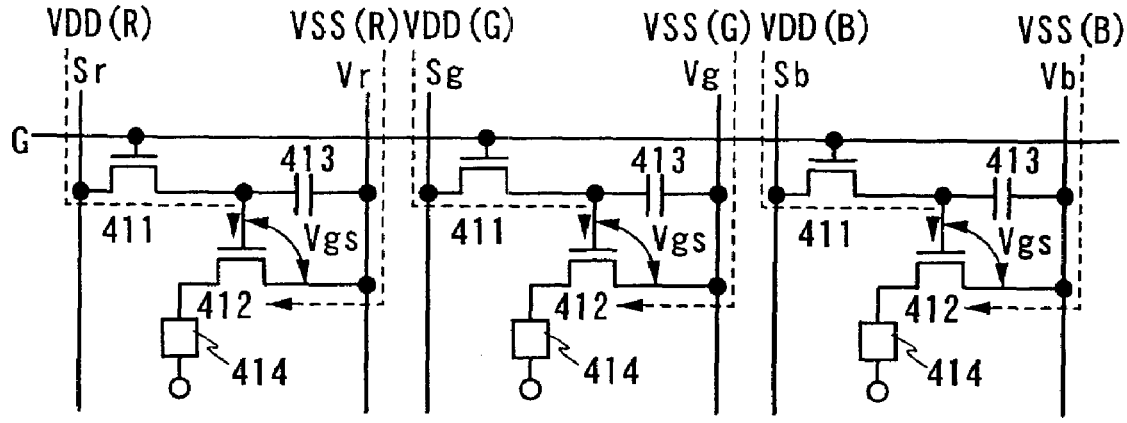
FIGS. 13A and 13B are circuit diagrams of a pixel portion of a light emitting device.

An explanation will be given of operation of the pixels of FIG. 4A when the signal lines Sr, Sg and Sb are respectively applied with VDD(R), VDD(G) and VDD(B) in the case in which the driving transistor is of an n-channel type transistor in reference to FIG. 13A. When the scanning line G is selected, all of switching transistors 411 of respective pixels are turned ON and potential VDD(R), VDD(G) and VDD(B) of the video signals applied to the respective signal lines Sr, Sg and Sb are applied to gate electrodes of driving transistors 412 of the respective pixels.

Meanwhile, the power source lines Vr, Vg and Vb are respectively applied with the power source potential VSS(R), VSS(G) and VSS(B) and the respective power source potential VSS(R), VSS(G) and VSS(B) are respectively applied to source regions of driving transistors 412 of correspondence pixels.

Therefore, gate voltage Vgs of the driving transistors 412 of the respective pixels becomes VDD(R)−VSS(R) in the case of the pixel for R, VDD(G)−VSS(G) in the case of the pixel for G and VDD(B)−VSS(B) in the case of the pixel for B. Here, since VDD(R)>VSS(R), VDD(G) VSS(G) and VDD (B)>VSS(B), the gate voltage Vgs becomes positive and when threshold voltage is assumed to be 2V, the driving transistors 412 are turned ON. Further, the gate voltages of the respective pixels are maintained in storage capacitors 413.

When it is assumed to correct to increase brightness of the light emitting element 414 for R and reduce brightness of the light emitting element 414 of G in order to take balance of white color, in this case, it is assumed that VDD(R)−VSS(R) >VDD(B)−VSS(B)>VDD(G)−VSS(G). Further, it is assumed that VSS(R)<VSS(B)<VSS(G). Therefore, potential of the power source line having the lowest potential is VSS(R) and therefore, VSS(LS)≦VSS(R)<VSS(B)<VSS (G).

Further, although according to the embodiment mode, the correction is carried out to increase the brightness of R and reduce the brightness of G, the invention is not limited thereto. Levels of the respective potential are changed pertinently in accordance with properties of electroluminescence materials used in the light emitting elements.

Further, it is not necessarily needed that VDD in correspondence with a color which is intended to increase of brightness is higher than VDD in correspondence with other colors. A voltage applied to a light emitting element of a color which is intended to increase the brightness may be larger than a voltage applied to a light emitting element in correspondence with other colors. Therefore, a relationship between the power source potential VSS in correspondence with each color and the level of the power source potential VDD is not limited to a relationship shown in the embodiment.

Further, it is not necessarily needed that potential difference between VSS and VDD of a color which is intended to increase the brightness is higher than potential difference between VSS and VDD of other colors in a case that a luminous efficiency of electroluminescence material of a color which is intended to increase the brightness is remarkably higher than that of electroluminescence material of other colors.

Figure 13B:
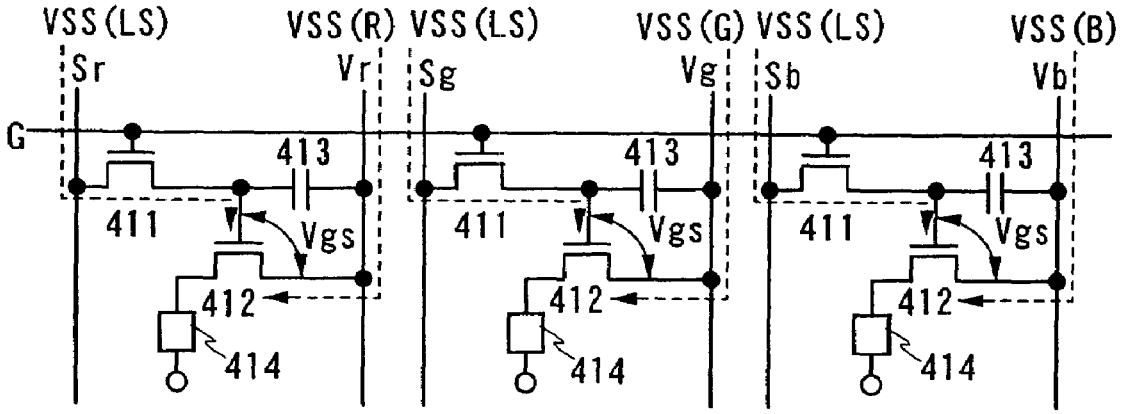

Next, an explanation will be given of operation of the pixel of FIG. 4B when the signal lines Sr, Sg and Sb are respectively applied with VSS(LS) in the case in which the driving transistor is of an n-channel type transistor in reference to FIG. 13B. When the scanning line G is selected, all of the switching transistors 411 of the respective pixels are turned ON and potential VSS(LS) of the video signals applied to the respective signal lines Sr, Sg and Sb is applied to the gate electrodes of the driving transistors 412 of the respective pixels.

Meanwhile, the power source lines Vr, Vg and Vb are respectively applied with power source potential VSS(R), VSS(G) and VSS(B) and the respective power source potential VSS(R), VSS(G) and VSS(B) are respectively applied to the source regions of the driving transistors 412 of the corresponding pixels.

Therefore, the gate voltage Vgs of the driving transistors 412 of the respective pixels becomes VSS(LS)−VSS(R) in the case of the pixel for R, VSS(LS)−VSS(G) in the case of the pixel for G and VSS(LS)−VSS(B) in the case of the pixel for B. Here, since VSS(LS)≦VSS(R)<VSS(B)<VSS(G), all of the gate voltages Vgs become equal to or lower than 0 and when the threshold voltage is assumed to be 2V, the driving transistors 412 are turned OFF and all of the light emitting elements are brought into a switched off state.

Further, the signal line drive circuit used in the invention is not limited to a structure shown in the embodiment. Further, the level shifter shown in the embodiment is not limited to structures shown in FIG. 3B and FIG. 11. Further, in place of the shift resistor, other circuit capable of selecting the signal line such as, for example, a decoder circuit may be used.

For example, when the level shifter is not used and the video signal outputted from LATB provided in the storing circuit B220*c* is inputted to a corresponding signal line without being amplified, in power source potential supplied to the LATB, power source potential used as potential of either one of Hi and Lo of the video signal may be changed by the respective corresponding colors. That is, according to the invention, in accordance with the polarity of the driving transistor, either one of potential of Hi and Lo of the video signal inputted to the pixel may be made to differ in level for the respective corresponding colors.

Further, when the output from the level shifter is buffer-amplified in a buffer, also potential supplied to the buffer are made to differ in levels of the respective corresponding colors such that potential of either one of Hi and Lo of the video signals inputted to the pixel in accordance with the polarity of the driving transistor can be made to differ in the levels of the respective colors.

According to the invention, by the above-described structure, the potential of the video signal inputted to the signal line is set and the potential of the power source line is set in compliance with the characteristic of the brightness of the light emitting element of each color and therefore, the balance of white color is maintained without increasing or reducing the potential of the power source line more than necessary and power consumption of the panel can be restrained.

Further, it is preferable to carry out the correction of the invention before delivery of the light emitting device.

Further, according to the invention, the light emitting element includes a layer (electroluminescence layer) including an electroluminescence material for providing luminescence (Electroluminescence) generated by applying an electroluminescence between an anode and a cathode. The electroluminescence layer is provided between the anode and the cathode and is constituted by a single layer or a plurality of layers. The luminescence in the electroluminescence layer includes luminescence (fluorescence) in returning from a singlet excited state to a ground state and luminescence (phosphorescence) in returning from a triplet excited state to a ground state.

Further, the light emitting element can take also a mode in which a hole injecting layer, an electron injecting layer, a hole transporting layer, and an electron transporting layer or the like included in the electroluminescence layer is formed by a material of an inorganic compound per se, or a material of an organic compound mixed with an inorganic compound. Further, the layers may partially be mixed with each other.

Further, according to the invention, the light emitting element may be an element the brightness of which is controlled by current or voltage and includes an electron source element (electron discharge element) of an MIM type used in FED (Field Emission Display), OLED (Organic Light Emitting Diode) or the like.

Further, the transistor used in the light emitting device of the invention may be a transistor formed by using single crystal silicon or may be a thin film transistor using polycrystal silicon or amorphous silicon. Further, the transistor may be a transistor using an organic semiconductor.

EMBODIMENTS

Embodiments of the invention will be explained as follows.

Embodiment 1

According to the embodiment, an explanation will be given of timing charts of the scanning line G, the power source lines Vr, Vg and Vb and the signal lines Sr, Sg and Sb when the switching transistor 401 is of the n-channel type and the driving transistor 402 is of the p-channel type in the pixels shown in FIG. 4A.

Figure 5:
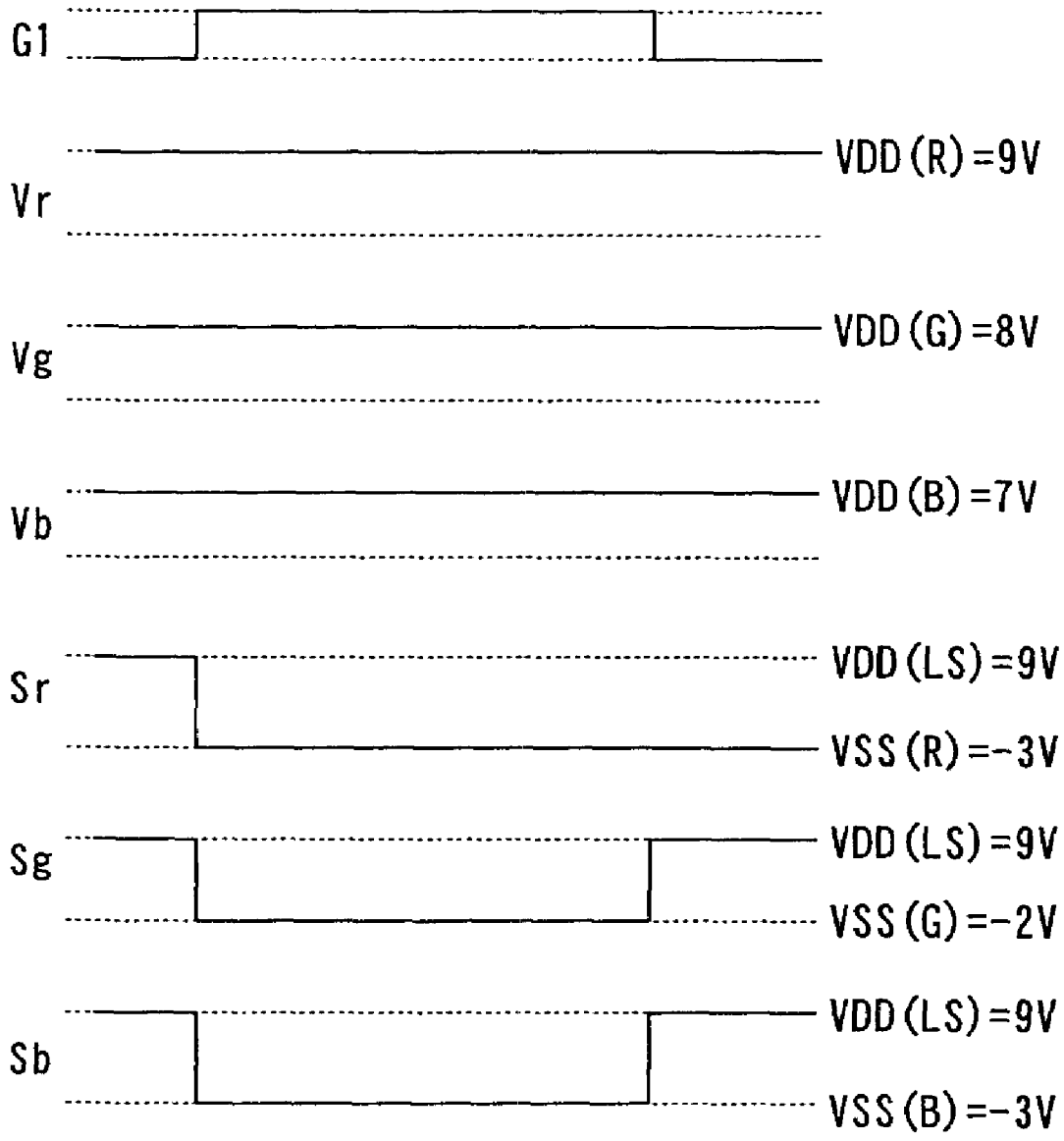
FIG. 5 is a timing chart of scanning lines, signal lines, and power source lines.

FIG. 5 shows the timing charts of the embodiment. According to the embodiment, the power source potential VDD(R) of the power source line is set to 9V, VDD(G) is set to 8V and VDD(B) is set to 7V. Further, VSS(R) in correspondence with potential of Lo of the signal line Sr is set to −3V, VSS(G) in correspondence with potential of Lo of the signal line Sg is set to −2V and VSS(B) in correspondence with potential of Lo of the signal line Sb is set to −3V. Further, the common potential VSS(LS) is used for the potential of Hi of the signal lines Sr, Sg and Sb and VSS(LS) is set to 9V.

When the potential of the scanning line G becomes Hi, the switching transistors 401 are turned ON. At this occasion, the potential of the video signals applied to the respective signal lines Sr, Sg and Sb are applied to the gate electrodes of the driving transistors 402.

When the potential of the video signal applied to the signal line Sr is Lo, the gate voltage Vgs(R) of the driving transistor 402 becomes VSS(R)−VDD(R)=−3V−9V=−12V. Therefore, the driving transistor 402 which is of the p-channel type is turned ON. Conversely, when the potential of the video signal applied to the signal line Sr is Hi, the gate voltage Vgs of the driving transistor 402 becomes VDD(LS)−VDD(R)=9V−9V=0V. Therefore, when the threshold is assumed to be −2V, the driving transistor 402 which is of the p-channel type is turned OFF.

Further, when the potential of the video signal applied to the signal line Sg is Lo, the gate voltage Vgs(G) of the driving transistor 402 becomes VSS(G)−VDD(G)=−2V−8V=−10V. Therefore, the driving transistor 402 which is of the p-channel type is turned ON. Conversely, when the potential of the video signal applied to the signal line Sg is Hi, the gate voltage Vgs of the driving transistor 402 becomes VDD(LS)−VDD(G)=9V−8V=1V. Therefore, when the threshold is assumed to be −2V, the driving transistor 402 which is of the p-channel type is turned OFF.

When the potential of the video signal applied to the signal line Sb is Lo, the gate voltage Vgs(B) of the driving transistor 402 becomes VSS(B)−VDD(B)=−3V−9V=−12V. Therefore, the driving transistor 402 which is of the p-channel type is turned ON. Conversely, when the potential of the video signal applied to the signal line Sb is Hi, the gate voltage Vgs of the driving transistor 402 becomes VDD(LS)−VDD(B)=9V−7V=2V. Therefore, when the threshold is assumed to be −2V, the driving transistor 402 which is of the p-channel type is turned OFF.

According to the embodiment, VDD(R)>VDD(G)>VDD(B). Further, when the driving transistor 402 which is of the p-channel type is turned ON, Vgs(G)>Vgs(R)=Vgs(B). By these conditions, when an absolute value of a voltage of a inverted direction bias applied to the light emitting element is the largest in R and the smallest in B, a width of correcting the brightness of R can be made the largest and the width of correcting the brightness of B can be restrained to the smallest.

Further, the timing charts shown in the embodiment are only an example and the timing charts of the light emitting device of the invention are not limited to those shown in the embodiment.

Further, although the according to the embodiment, only one scanning line is shown and only three pixels in correspondence with RGB sharing the scanning line are shown, the invention is not limited thereto.

Embodiment 2

The structure of the invention can be applied also to a pixel shown in FIG. 10B.

Figure 6:
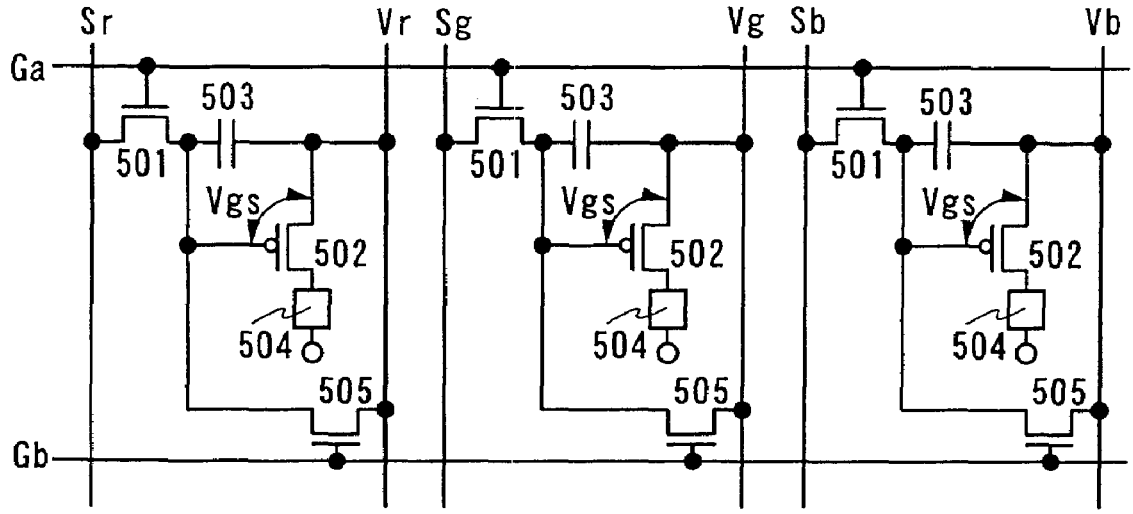
FIG. 6 is a circuit diagram of a pixel portion of a light emitting device.

An explanation will be given of a case of providing three transistors in the pixel in reference to FIG. 6. Basic operation of the pixel shown in FIG. 6 is the same as that of the pixel shown in FIG. 4A.

When a scanning line Ga is selected and switching transistors 501 of the respective pixels are turned ON, the potential of the video signal(s) VSS(R), VSS(G) and VSS(B) applied to the signal lines Sr, Sg and Sb are applied to gate electrodes of driving transistors 502 of the respective pixels.

Meanwhile, the power source lines Vr, Vg and Vb are respectively applied with the power source potential VDD (R), VDD(G) and VDD(B) and the respective power source potential VDD(R), VDD(G) and VDD(B) are respectively applied to source regions of the driving transistors 502 of the corresponding pixels.

Therefore, the gate voltage Vgs of driving transistors 502 of the respective pixels becomes VSS(R)−VDD(R) in the case of the pixel for R, VSS(G)−VDD(G) in the case of the pixel for G and VSS(B)−VDD(B) in the case of the pixel for B. Here, since VSS(R)<VDD(R), VSS(G)<VDD(G) and VSS(B)<VDD(B), the gate voltage Vgs becomes negative and when it is assumed that threshold voltage is −2V and the driving transistor 502 is of a p-channel type, the driving transistor 502 is turned ON. Therefore, the light emitting element is brought into a luminous state. Further, gate voltage of the respective pixels is held at storage capacitors 503.

When the potential applied to the signal lines Sr, Sg and Sb are potential VDD(LS) of the video signal, the gate voltage Vgs of the driving transistors 502 of the respective pixels becomes VDD(LS)−VDD(R) in the case of the pixel for R, VDD(LS)−VDD(G)in the case of the pixel for G and VDD (LS)−VDD(B) in the case of the pixel for B. Here, since VDD(LS) is set to be equal to or higher than potential of any other power source line, all of the gate voltages Vgs become equal to or higher than 0 and when the threshold is assumed to be −2V, the driving transistors 502 are turned OFF. Therefore, the light emitting element is brought into a switched off state.

Further, when selection of the scanning line Ga has been finished and a scanning line Gb is selected, an erasing transistor 505 is turned ON and therefore, all of the gate voltages Vgs of the driving transistors 502 become 0 and when the threshold is assumed to be −2V, all of the driving transistors 502 are turned OFF. Therefore, the light emitting elements of all of the pixels sharing the scanning line Gb are brought into a forcibly switched off state regardless of potential of the video signal.

Further, although according to the embodiment, there is assumed a case in which the transistor for controlling current applied to the light emitting element is the p-channel type transistor, the transistor may be an n-channel type transistor. With regard to potential of the respective signal lines and power source lines when the driving transistors are the n-channel type transistors, the explanation when driving transistors are the n-channel type transistors in the pixels of FIG. 13A of the embodiment can be referred to.

The embodiment can be carried out in combination with EMBODIMENT 1.

Embodiment 3

According to the embodiment, an explanation will be given of a relationship between an operating region of a driving transistor and voltage applied to a light emitting element.

According to the invention, voltage $V_{EL}$ applied to a light emitting element is made to differ for respective colors by making not only potential of a power source line but also gate voltage Vgs of a driving transistor differ for respective corresponding colors. Therefore, it is preferable to operate a driving transistor in an operating region capable of controlling voltage $V_{EL}$ applied to a light emitting element by controlling gate voltage.

Figure 7A:
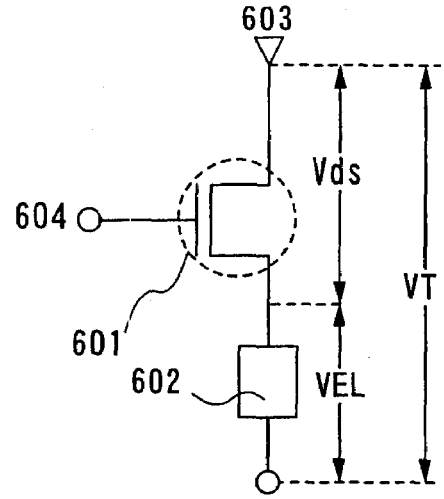
FIGS. 7A and 7B are diagrams illustrating an operation region of a driving transistor.
Figure 7B:
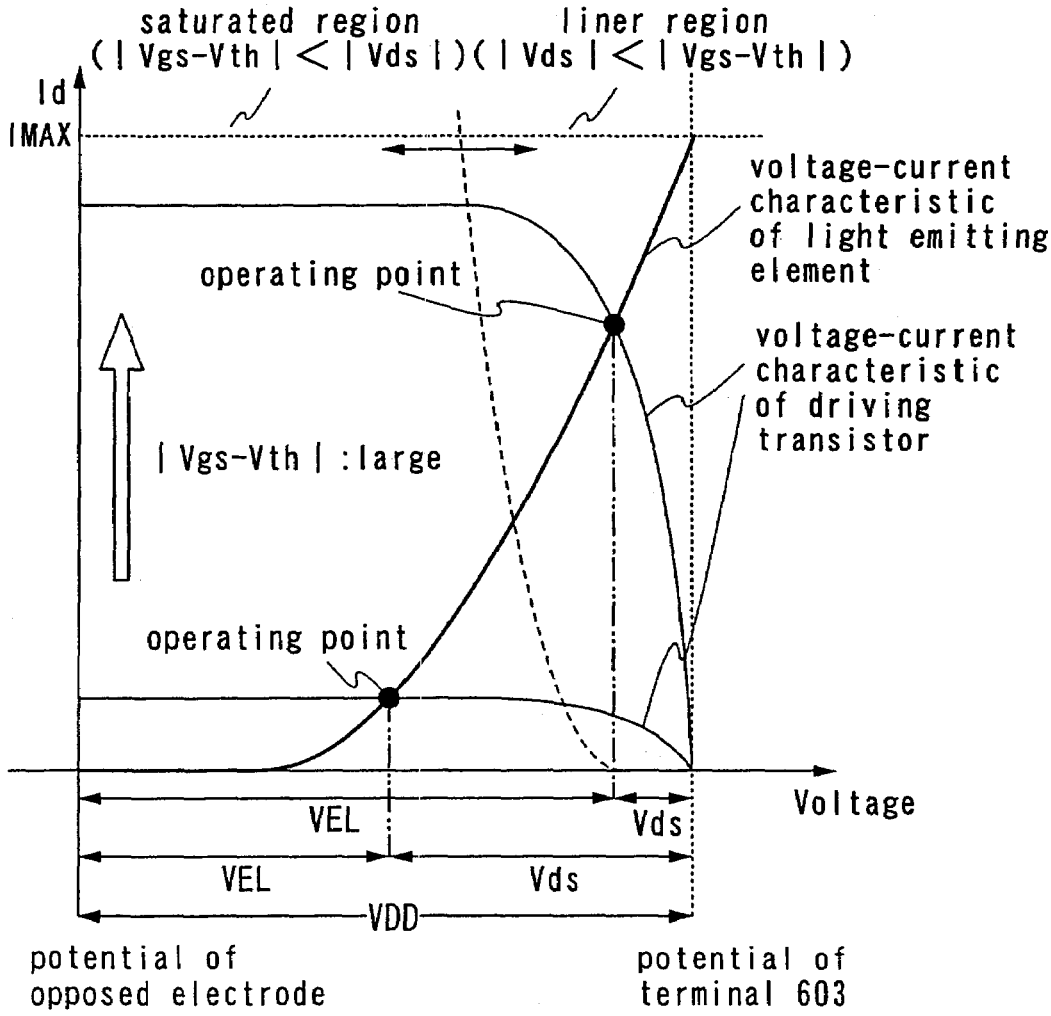

FIGS. 7A and 7B will be referred. FIG. 7A illustrates only a structure of connecting a driving transistor 601 and a light emitting element 602 in a pixel of a light emitting device according to the invention. Further, FIG. 7B shows voltage current characteristics of the driving transistor 601 and the light emitting element 602 shown in FIG. 7A. Further, a graph of the voltage current characteristic of the driving transistor 601 shown in FIG. 7B shows a magnitude of drain current of the driving transistor 601 relative to Vds which is voltage between the source region and the drain and FIG. 7B shows two graphs having different values of the gate voltage Vgs of the driving transistor 601.

As shown by FIG. 7A, a voltage applied between a pixel electrode and an opposed electrode of the light emitting element 602 is designated by notation $V_{EL}$ and a voltage applied between a terminal 603 connected to a power source line and the opposed electrode of the light emitting element 602 is designated by notation $V_T$. Further, $V_T$ is a fixed value determined by potential of the opposed electrode and potential of the power source line. Further, a voltage between a terminal 604 connected to a gate electrode of the driving transistor 601 and a source region thereof corresponds to the gate voltage Vgs.

The driving transistor 601 may be of an n-channel type transistor or a p-channel type transistor.

The driving transistor 601 is connected in series with the light emitting element 602 and therefore, values of current flowing in the two elements are the same. Therefore, the driving transistor 601 and the light emitting element 602 shown in FIG. 7A are operated at an intersection (operating point) of the graphs showing the voltage-current characteristics of the two elements. In FIG. 7B, $V_{EL}$ becomes a voltage between potential of the opposed electrode and potential at operating point. Vds becomes a voltage between potential at the terminal 603 and potential at the operating point. That is, $V_T=V_{EL}+Vds$.

Further, as shown by FIG. 7B, the voltage current characteristic of the driving transistor 601 is divided into two regions by values of Vgs and Vds. A region of $|Vgs-Vth|<|Vds|$ is a saturated region and a region of $|Vgs-Vth|>|Vds|$ is a linear region. Further, notation Vth designates threshold voltage of the driving transistor 601.

Therefore, since $|V_{EL}|>>|Vds|$ when the operating point is disposed in the linear region, even when Vgs is made to differ for respective colors, a difference in Vgs is difficult to be reflected to a value of $V_{EL}$. However, when the operating point is disposed in the saturated region, |Vds| is larger than $|V_{EL}|$ or even when |Vds| is small, an order to the same degree is maintained. Therefore, when Vgs is made to differ for respective colors, the difference in Vgs is easy to be reflected to the value of $V_{EL}$ and correction of the brightness is easy to carry out.

Therefore, according to the invention, it is preferable to operate the driving transistor in the saturated region.

Further, when the operating point is disposed in the saturated region, the drain current Id of the driving transistor 601 follows Equation (1) shown below. Further, in Equation (1), $\beta=\mu C_0 W/L$, notation $\mu$ designates a mobility, notation $C_0$ designates a gate capacitance per unit area and notation W/L designates a ratio of a channel width W to a channel length L of a channel forming region.

$$Id=\beta(Vgs-Vth)^2/2 \quad \text{Equation (1)}$$

It is known from Equation (1) that in the saturated region, the current Id is not changed by Vds and is determined only by Vgs. Therefore, even when Vds is reduced instead of increasing $V_{EL}$ by deteriorating the light emitting element, so far as Vgs is maintained at a constant value, the operation at the saturated region can be maintained, and therefore, the value of the drain current Id is maintained constant in accordance with Equation (1).

Since the current is maintained constant and the brightness and the current of the light emitting element are brought into a proportional relationship, even when the light emitting element is deteriorated, a reduction in the brightness can be restrained.

The embodiment can be carried out in combination with Embodiment 1 or 2.

Embodiment 4

In the present embodiment, a light emitting device according to the present invention will be described on the whole. The light emitting device according to the present invention includes a panel in which a light emitting element is sealed, a module in which the panel is provided with a controller and an IC including a circuit such as a power source circuit. The panel and the module are both corresponding to one mode of the light emitting device. In the present embodiment, a specific configuration of the module will be described.

Figure 8A:
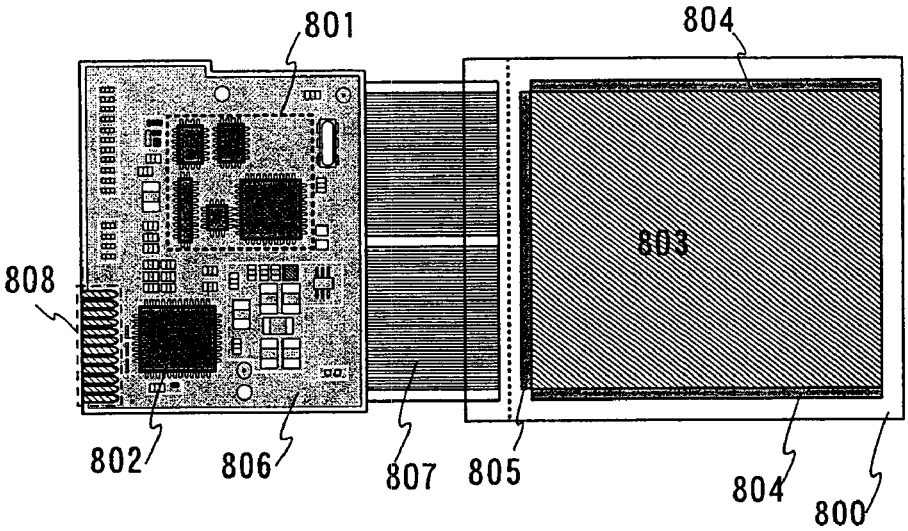
FIG. 8A is an appearance of a light emitting device and 8B is a block diagram of a controller according to the present invention.

FIG. 8A shows an appearance of a module in which a panel 800 is provided with a controller 801 and a power source circuit 802. There are provided in the panel 800 a pixel portion 803 in which a light emitting element is provided in each pixel, a scanning line drive circuit 804 for selecting a pixel in the pixel portion 803, and a signal line drive circuit 805 for supplying a video signal to the selected pixel.

The controller 801 and the power source circuit 802 are provided in a printed substrate 806, various kinds of signals and power source potential output from the controller 801 and the power source circuit 802 are supplied via FPC 807 to the pixel portion 803, the scanning line drive circuit 804, and the signal line drive circuit 805 of the pixel portion 803.

Via an interface (I/F) 808 in which a plurality of input terminals are arranged, power source potential and various kinds of signals to the printed circuit 806 is supplied.

Although the printed substrate 806 is attached to the panel 800 with the FPC 807 in the present embodiment, the present invention is not limited to this configuration. The controller 801 and the power source circuit 802 may be provided directly in the panel 800 with a COG (Chip on Class) method.

Further, in the printed circuit 806, there is a case that a capacitor formed between leading wirings and a resistance of a wiring itself cause a noise to power source potential or a signal, or make a rise of a signal dull. Therefore, it may prevent the noise to the power source potential or a signal and the dull rise of the signal to provide various kinds of elements such as a condenser and a buffer in the printed substrate 806.

Figure 8B:
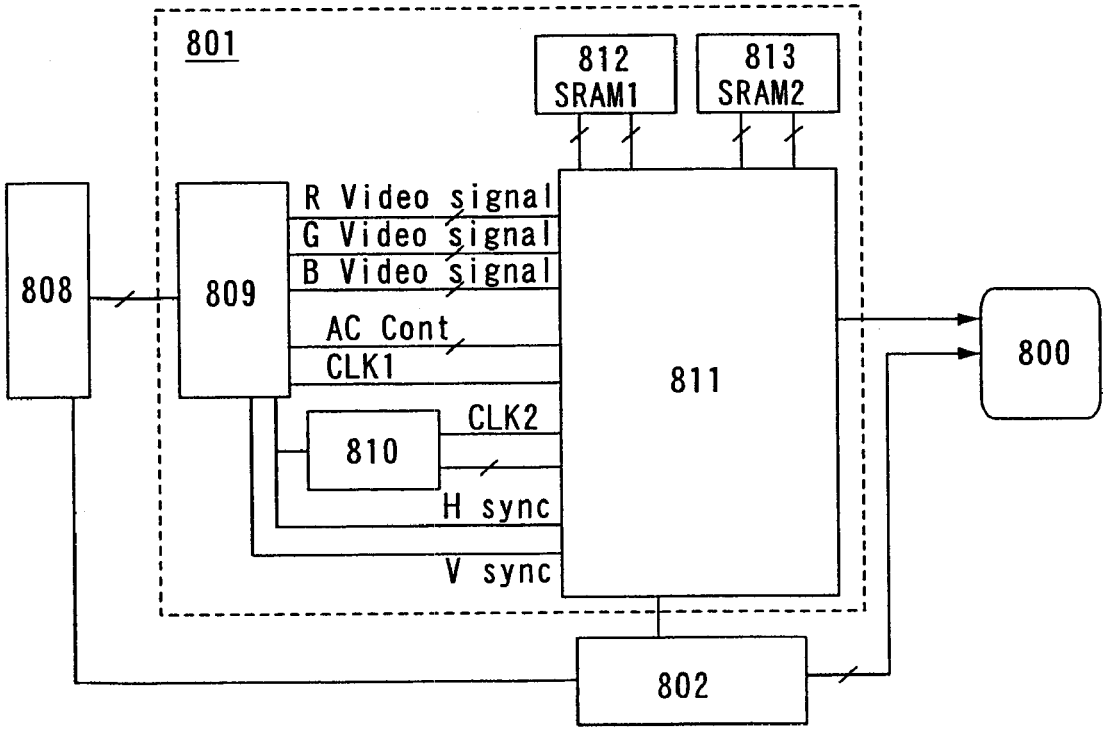

FIG. 8B is a block diagram showing a configuration of the printed substrate 806. Various kinds of signals and power source potential supplied to the interface 808 are supplied to the controller 801 and the power source circuit 802.

The controller 801 has an A/D converter 809, a phase locked loop (PLL) 810, control signal generating portion 811, and SRAM (Static Random Access Memory) 812 and 813. Although the SRAM is used in the present embodiment, instead of the SRAM, SDRAM can be used and DRAM (Dynamic Random Access Memory) can also be used if it is possible to write in and read out data at high speed.

Video signals supplied via the interface 808 are subjected to a parallel-serial conversion in the AID converter 809 to be input to the control signal generating portion 811 as video signals corresponding to respective colors of R, G, and B. Further, based on various kinds of signals supplied via the interface 808, H sync signal, V sync signal, clock signal (CLK), and AC cont are generated in the A/D converter 809 to be input into the control signal generating portion 811.

The phase locked loop 810 has a function of synchronizing frequencies of the various kinds of signals supplied via the interface 808 and an operation frequency of the control signal generating portion 811. The operation frequency of the control signal generating portion 811 is not always the same as the frequencies of the various kinds of signals supplied via the interface 808, and adjusted in the phase locked loop 810 in order to synchronize each other.

The video signals input to the control signal generating portion 811 are once written in the SRAM 812 and 813 and stored. In the control signal generating portion 811, a bit of video signal of the all bits of video signals stored in the SRAM 812 is read out for each pixel and input to a signal line drive circuit 805 of the panel 800.

Further, in the control signal generating portion 811, information for each bit on a period during which the light emitting element emits light, is input to a scanning line drive circuit 804 of the panel 800.

In addition, the power source circuit 802 supplies predetermined potential to the signal line drive circuit 805, the scanning line drive circuit 804, and the pixel portion 803 of the panel 800.

Next, a detailed configuration of the power source circuit 802 will be described with FIG. 9. The power source circuit 802 of the present embodiment is composed of a switching regulator 854 that employs four switching regulator controls 860 and a series regulator 855.

In general, a switching regulator is smaller and lighter than a series regulator, and capable of not only step-down but also step-up and inversion of positive and negative. On the other hand, the series regulator is used only for step-down while output power source potential has a high precision, compared to the switching regulator, and there is almost no possibility for occurrence of a ripple or a noise. The power source circuit 802 in the present embodiment uses the both combined.

Figure 9:
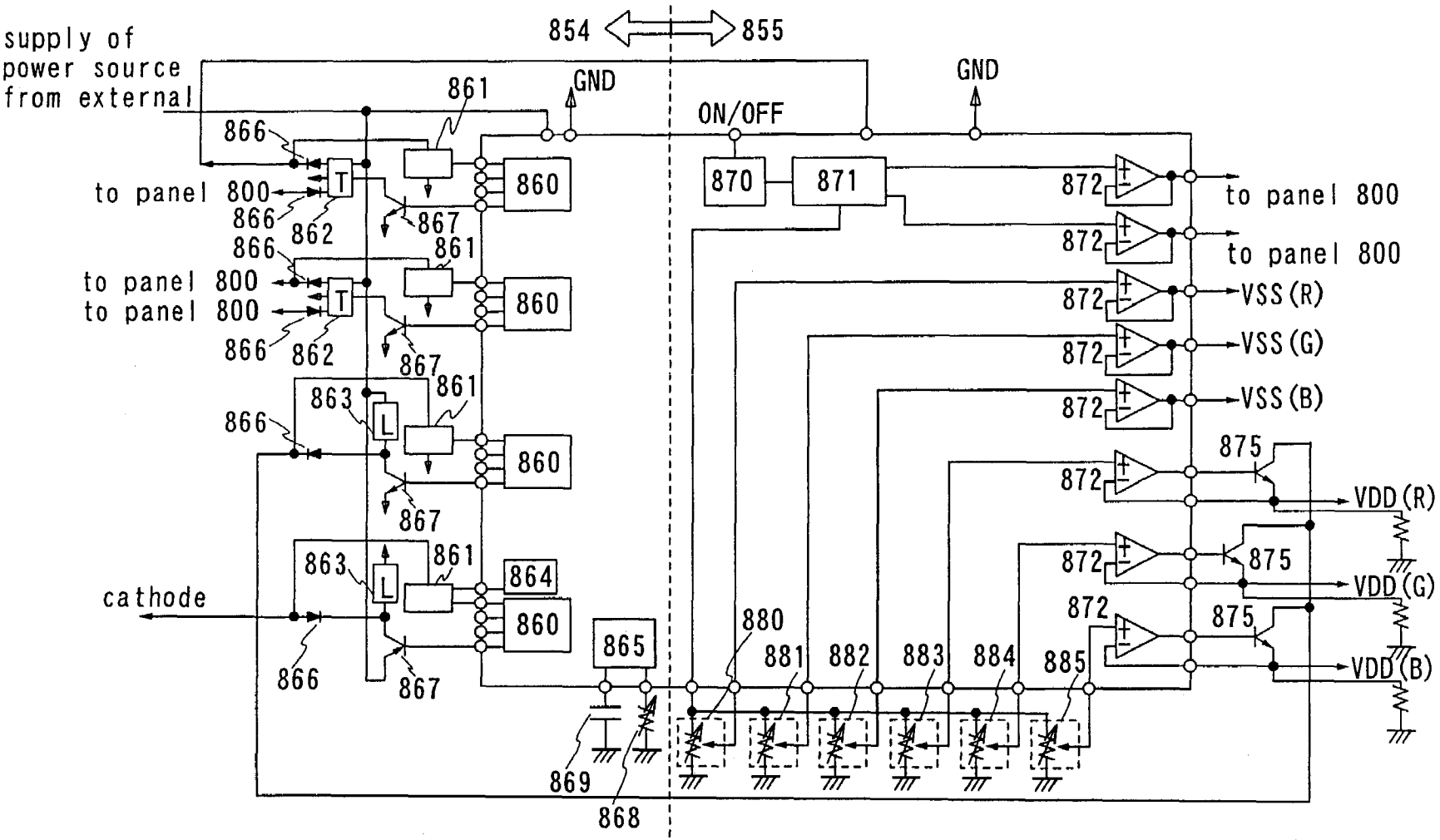
FIG. 9 is a block diagram of a power source circuit.

The switching regulator 854 shown in FIG. 9 has the switching regulator controls (SWR) 860, attenuators (ATT) 861, transformers (T) 862, inductors (L) 863, a reference power source (Vref) 864, an oscillation circuit (OSC) 865, diodes 866, bipolar transistors 867, a variable resistor 868, and a capacitor 869.

When a voltage of such an outside Li ion buttery (3.6 V) is converted in the switching regulator 854, power source potential given to a cathode and power source potential supplied to the switching regulator 854 are generated.

Further, the series regulator 855 has a band gap circuit (BG) 870, an amplifier 871, operational amplifiers 872, variable resistors 880 to 885, and bipolar transistors 875, and the power source potential generated in the switching regulator 854 is supplied thereto.

In the series regulator 855, based on predetermined potential generated in the band gap circuit 870, direct current of power source potential, used as one of Hi and Lo of a video signal and potential of a power source line for supplying current to an anode of a light emitting element corresponding each color, is generated with using the power source potential generated in the switching regulator 854.

Specifically, VSS (R), VSS (G), VSS (B), VDD (R), VDD (G), and VDD (B) are generated in the series regulator 855.

Further, the present embodiment can be combined with any one of Embodiment Modes 1 to 3.

Embodiment 5

According to present invention, by the above-described configuration, the balance of white color is maintained without increasing or reducing the potential of the power source line more than necessary and power consumption of the panel can be restrained.

Given as examples of electronic apparatuses that employ the light emitting device manufactured in accordance with the present invention are video cameras, digital cameras, goggle type displays (head mounted displays), navigation systems, audio reproducing devices (such as car audio and audio components), laptop computers, game machines, portable information terminals (such as mobile computers, cellular phones, portable game machines, and electronic books), and image reproducing devices equipped with recording media (specifically, devices with a display device that can reproduce data in a recording medium such as a digital versatile disk (DVD) to display an image of the data). A wide viewing angle is important particularly for portable information terminals because their screens are often viewed from a tilted direction. Therefore it is preferable for portable information terminals to employ the light emitting device using the light emitting element. Specific examples of these electronic apparatuses are shown in FIG. 12A-12H.

Figure 12A:
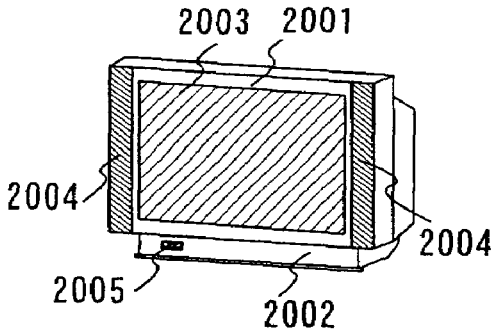
FIGS. 12A to 12H are electronic apparatuses using a light emitting device of the present invention.

FIG. 12A shows a display device including a case 2001, a support base 2002, a display unit 2003, speaker units 2004, a video input terminal 2005, etc. The light emitting device manufactured in accordance with the present invention can be applied to the display unit 2003. In addition, the light emitting device shown in FIG. 12A can be completed by the present invention. Since the light emitting device having the light emitting element is of self-luminous type, the device does not need a backlight and can make a thinner display unit than that of a liquid crystal display device. The light emitting device refers to all light emitting devices for displaying information, including ones for personal computers, for TV broadcasting reception, and for advertisement.

Figure 12B:
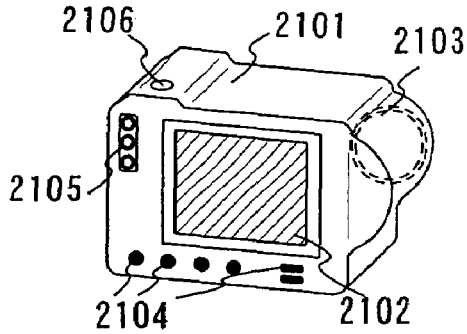

FIG. 12B shows a digital still camera including a main body 2101, a display unit 2102, an image receiving unit 2103, operation keys 2104, an external connection port 2105, a shutter 2106, etc. The light emitting device manufactured in accordance with the present invention can be applied to the display unit 2102. The digital camera shown in FIG. 12B can be completed by the present invention.

Figure 12D:
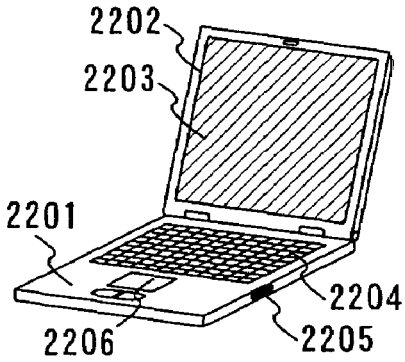
Figure 12C:
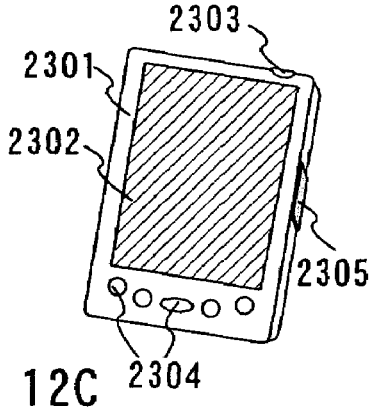

FIG. 12C shows a laptop computer including a main body 2201, a case 2202, a display unit 2203, a keyboard 2204, an external connection port 2205, a touch pat 2206, etc. The light emitting device manufactured in accordance with the present invention can be applied to the display unit 2203. The laptop computer shown in FIG. 12C can be completed by the present invention.

FIG. 12D shows a mobile computer including a main body 2301, a display unit 2302, a switch 2303, operation keys 2304, an infrared port 2305, etc. The light emitting device manufactured in accordance with the present invention can be applied to the display unit 2302. The mobile computer shown in FIG. 12D can be completed by the present invention.

Figure 12E:
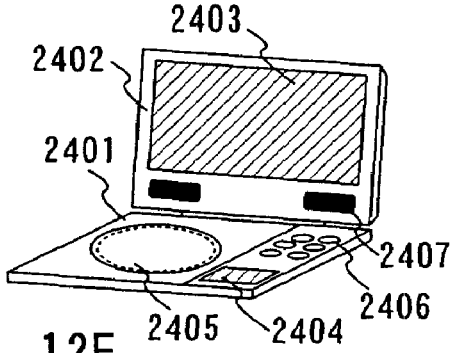

FIG. 12E shows a portable image reproducing device equipped with a recording medium (a DVD player, to be specific). The device includes a main body 2401, a case 2402, a display unit A 2403, a display unit B 2404, a recording medium (DVD or the like) reading unit 2405, operation keys 2406, speaker units 2407, etc. The display unit A 2403 mainly displays image information whereas the display unit B 2404 mainly displays text information. The light emitting device manufactured in accordance with the present invention can be applied to the display units A 2403 and B 2404. The image reproducing device equipped with a recording medium also includes home-video game machines. The DVD player shown in FIG. 12E can be completed by the present invention.

Figure 12F:
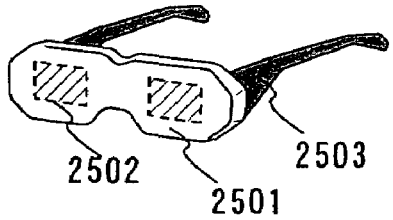

FIG. 12F shows a goggle type display (head mounted display) including a main body 2501, display units 2502, and arm units 2503. The light emitting device manufactured in accordance with the present invention can be applied to the display units 2502. The goggle type display shown in FIG. 12F can be completed by the present invention.

Figure 12G:
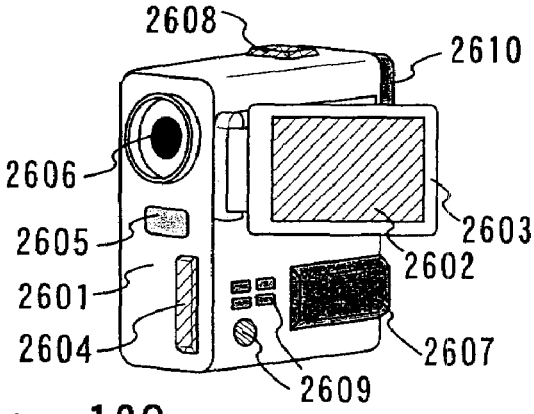

FIG. 12G shows a video camera including a main body 2601, a display unit 2602, a case 2603, an external connection port 2604, a remote control receiving unit 2605, an image receiving unit 2606, a battery 2607, an audio input unit 2608, operation keys 2609, an eye piece 2610 etc. The light emitting device manufactured in accordance with the present invention can be applied to the display unit 2602. The video camera shown in FIG. 12G can be completed by the present invention.

Figure 12H:
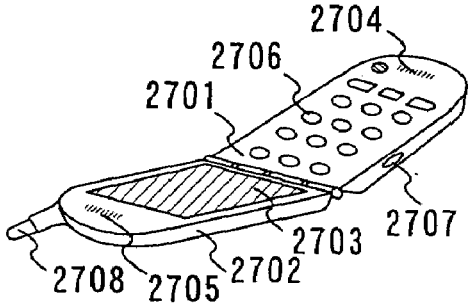

FIG. 12H shows a cellular phone including a main body 2701, a case 2702, a display unit 2703, an audio input unit 2704, an audio output unit 2705, operation keys 2706, an external connection port 2707, an antenna 2708, etc. The light emitting device manufactured in accordance with the present invention can be applied to the display unit 2703. When the display unit 2703 displays white letters on a black background, the cellular phone may consume less power. The cellular phone shown in FIG. 12H can be completed by the present invention.

When a brighter luminance of an organic electroluminescence material becomes available in the future, the light emitting device can be used in front type or rear type projectors by enlarging outputted light that contains image information through a lens or the like and projecting the light.

The aforementioned electronic apparatuses are more likely to be used for display information distributed through a telecommunication path such as Internet, a CATV (cable television system), and in particular likely to display moving picture information. The light-emitting device is suitable for displaying moving pictures since the organic electroluminescence material can exhibit high response speed.

A portion of the light emitting device that is emitting light consumes power, so it is desirable to display information in such a manner that the light emitting portion therein becomes as small as possible. Accordingly, when the light emitting device is applied to a display portion which mainly displays character information, e.g., a display portion of a portable information terminal, and more particular, a portable telephone or a sound reproduction device, it is desirable to drive the light emitting device so that the character information is formed by a light-emitting portion against a non-emission portion as a background.

As set forth above, the present invention can be applied variously to a wide range of electronic apparatuses in all fields. The electronic apparatuses in this embodiment can be obtained by utilizing the structure of a light-emitting device shown in Embodiments 1 to 4.

According to present invention, by the above-described structure, the balance of white color can be maintained without increasing or reducing the potential of the power source line more than necessary, and moreover, power consumption of the panel can be restrained.

What is claimed is:

1. A method of a driving a light emitting device, the light emitting device comprising a plurality of first pixels electrically connected to a first line and a second line, a plurality of second pixels electrically connected to a third line and a fourth line, each of the plurality of first and second pixels comprising a light emitting element and a transistor electrically connected to the light emitting element, the method comprising:

applying a first potential to the first line;

applying a second potential to the second line, wherein the second potential is a constant potential;

applying a third potential to the third line;

applying a fourth potential to the fourth line, wherein the fourth potential is a constant potential, wherein each of the light emitting elements included in the first and second pixels emits a light when the first potential is different from the third potential, wherein each of the light emitting elements included in the first and second pixels does not emit a light when the first potential is the same as the third potential, wherein the second potential is different from the fourth potential, and wherein the transistor is operated in a saturated region when the light emitting element emits light.

2. The method according to claim 1, wherein the plurality of first pixels emit a light corresponding to a color selected from the group consisting of red, green, and blue and the color is different from a color of a light emitted from the second pixels.

3. The method according to claim 1, wherein the plurality of second pixels emit a light corresponding to a color selected from the group consisting of red, green, and blue and the color is different from a color of a light emitted from the first pixels.

4. The method according to claim 1, wherein the plurality of first pixels emit a light different from that emitted from the plurality of second pixels.

5. The method according to claim 1, wherein the transistor is a p-channel type transistor.

6. The method according to claim 5, wherein the first and third potentials when the p-channel type transistor is turned off stay the same and are equal to or higher than a highest potential among the second and fourth potentials.

7. The method according to claim 1, wherein the transistor is an n-channel type transistor.

8. The method according to claim 7, wherein the first and third potentials when the n-channel type transistor is turned off stay the same and are equal to or lower than a lowest potential among the second and fourth potentials.

9. The method according to claim 1, wherein a voltage applied to light emitting elements included in the plurality of first pixels is different from a voltage applied to light emitting elements included in the plurality of second pixels.

10. A method of driving a light emitting device, the light emitting device comprising a plurality of first pixels connected to a first signal line and a first power source line, a plurality of second pixels connected to a second signal line and a second power source line, each of the plurality of first and second pixels comprising a light emitting element and a transistor connected to the light emitting element, the method comprising:

applying a first video signal to the first signal line;

applying a second video signal to the second signal line;

applying a first voltage to the first power source line; and applying a second voltage to the second power source line, wherein each of the light emitting elements included in the first and second pixels emits a light when a potential of the first video signal is different from a potential of the second video signal, wherein each of the light emitting elements included in the first and second pixels does not emit a light when a potential of the first video signal is the same as a potential of the second video signal, wherein a potential of the first power source line is different from a potential of the second power source line, and wherein the transistor is operated in a saturated region.

11. The method according to claim 10, wherein the plurality of first pixels emit a light corresponding to a color selected from the group consisting of red, green, and blue, and the color is different from a color of a light emitted from the second pixels.

12. The method according to claim 10, wherein the plurality of second pixels emit a light corresponding to a color selected from the group consisting of red, green, and blue, and the color is different from a color of a light emitted from the first pixels.

13. The method according to claim 10, wherein the plurality of first pixels emit a light different from that emitted from the plurality of second pixels.

14. The method according to claim 10, wherein the first video signal is a signal that turns on transistors provided at the plurality of first pixels, and the second video signal is a signal that turns on transistors provided at the plurality of second pixels.

15. The method according to claim 10, wherein the transistor is a p-channel type transistor.

16. The method according to claim 15, wherein potentials of the first and second signal lines when the p-channel type transistor is turned off stay the same and are equal to or higher than a highest potential in the first and second power source lines.

17. The method according to claim 10, wherein the transistor is an n-channel type transistor.

18. The method according to claim 17 wherein potentials of the first and second signal lines when the n-channel type transistor is turned off stay the same and are equal to or lower than a lowest potential in the first and second power source lines.

* * * * *